US011300336B2

(12) United States Patent
Ye et al.

(10) Patent No.: US 11,300,336 B2
(45) Date of Patent: Apr. 12, 2022

(54) FLUID CONTROL ASSEMBLY

(71) Applicant: Zhejiang Sanhua Intelligent Controls Co., Ltd., Shaoxing (CN)

(72) Inventors: Jiabin Ye, Zhejiang (CN); Zhou Lv, Zhejiang (CN); Jiang Zou, Zhejiang (CN); Gang Lv, Zhejiang (CN)

(73) Assignee: Zhejiang Sanhua Intelligent Controls Co., Ltd., Shaoxing (CN)

( * ) Notice: Subject to any disclaimer, the term of this patent is extended or adjusted under 35 U.S.C. 154(b) by 35 days.

(21) Appl. No.: 16/644,715

(22) PCT Filed: Aug. 23, 2018

(86) PCT No.: PCT/CN2018/101904
§ 371 (c)(1),
(2) Date: Mar. 5, 2020

(87) PCT Pub. No.: WO2019/047720
PCT Pub. Date: Mar. 14, 2019

(65) Prior Publication Data

US 2020/0284483 A1 Sep. 10, 2020

(30) Foreign Application Priority Data

Sep. 11, 2017 (CN) ..... 201710810786.7
Oct. 27, 2017 (CN) ..... 201721406768.4

(51) Int. Cl.
*F25B 41/00* (2021.01)
*F25B 41/20* (2021.01)

(52) U.S. Cl.
CPC ..... *F25B 41/00* (2013.01); *F25B 41/20* (2021.01)

(58) Field of Classification Search
CPC ..... F25B 41/00; F25B 41/20; F25B 2500/27; F28D 2021/0068; F28D 9/005; F28F 9/0253; F28F 27/02; F28F 9/026
(Continued)

(56) References Cited

U.S. PATENT DOCUMENTS 9,255,748 B2 * 2/2016 Cho ..... F28D 9/005
9,464,853 B2 * 10/2016 Sheppard ..... F28F 27/00
(Continued)

FOREIGN PATENT DOCUMENTS

CN 205748088 U 11/2016
CN 205940233 U 2/2017
(Continued)

OTHER PUBLICATIONS

EP18853052.1, dated Apr. 29, 2021, Extended European Search Report.
(Continued)

*Primary Examiner* — Ana M Vazquez
(74) *Attorney, Agent, or Firm* — Wolf, Greenfield & Sacks, P.C.

(57) ABSTRACT

A fluid control assembly is provided, which includes a heat exchange core, a mounting block and a valve core member. At least a part of the valve core member is arranged in a first mounting hole passage of the mounting block, and the valve core member is sealable to a wall portion of the first mounting hole passage. In this way, the fluid control assembly includes a fluid flow passage that includes a first port, a second hole passage, a first hole passage, a first sub-passage, a communication hole, a second sub-passage, and a second port. A core body of the valve core member is operated under a pressure difference between the first sub-passage and the second sub-passage, to communicate or block the first sub-passage and the second sub-passage, to realize a con-
(Continued)

stant flow direction of the fluid flow passage of the fluid control assembly.

18 Claims, 17 Drawing Sheets

(58) Field of Classification Search
USPC ..... 62/171
See application file for complete search history.

(56) References Cited

U.S. PATENT DOCUMENTS

| | | | | |
|---|---|---|---|---|
| 2013/0327287 | A1* | 12/2013 | Kim | F28D 9/005 123/41.33 |
| 2016/0363399 | A1* | 12/2016 | Kim | F28F 27/02 |
| 2017/0175599 | A1* | 6/2017 | Ariyama | F01M 5/002 |

FOREIGN PATENT DOCUMENTS

| | | | |
|---|---|---|---|
| CN | 106711533 | A | 5/2017 |
| CN | 106918165 | A | 7/2017 |
| JP | 2011-220616 | A | 11/2011 |
| JP | 2013-176914 | A | 9/2013 |
| WO | WO 2017/145619 | A1 | 8/2017 |

OTHER PUBLICATIONS

Office Action for Korean Application No. 10-2020-7009518, dated Feb. 1, 2021.
Extended European Search Report for European Application No. 18853052.1, dated Apr. 29, 2021.
International Search Report and Written Opinion for International Application No. PCT/CN2018/101904, dated Nov. 19, 2018.
KR10-2020-7009518, dated Feb. 1, 2021, Office Action.
PCT/CN2018/101904, dated Nov. 19, 2018, International Search Report and Written Opinion.

* cited by examiner

FLUID CONTROL ASSEMBLY

This application is a national stage filing under 35 U.S.C. § 371 of International Patent Application Serial No. PCT/CN2018/101904, filed Aug. 23, 2018, which claims the priority to Chinese patent applications No. 201710810786.7 titled "FLUID CONTROL ASSEMBLY", filed with the China National Intellectual Property Administration on Sep. 11, 2017, and Chinese patent application No. 201721406768.4 titled "FLUID CONTROL ASSEMBLY", filed with the China National Intellectual Property Administration on Oct. 27, 2017. The contents of these applications are incorporated herein by reference in their entireties.

FIELD

The present application relates to the fluid heat exchange field, and in particular to a fluid control assembly.

BACKGROUND

In a refrigeration system, a fluid heat exchange device is generally arranged. Refrigerant is one of mediums used in the fluid heat exchange device, and the refrigerant may be used to exchange heat in the fluid heat exchange device. In the refrigeration system, the flow direction of the refrigerant through the fluid heat exchange device is constant according to the system requirement. However, in a case that a compressor is turned on/off, there is a tendency for the refrigerant to reflux. Therefore, a technical problem to be solved is how to provide a fluid control assembly with a constant flow direction.

SUMMARY

An object of the present application is to provide a fluid control assembly, at least one flow passage of which is embodied as a one-way flow passage.

In order to achieve the above object, the following technical solutions are provided.

A fluid control assembly includes a heat exchange core and a mounting block. The heat exchange core includes a fluid flow passage, and the fluid flow passage includes a first hole passage and a second hole passage. The mounting block and the heat exchange core are fixed by welding. The mounting block includes a first mounting hole passage and a second mounting hole passage, the first mounting hole passage is in communication with the first hole passage, and the second mounting hole passage is in communication with the second hole passage.

The fluid control assembly further includes a valve core member, and at least part of the valve core member is arranged in the first mounting hole passage. The mounting block includes a wall portion forming the first mounting hole passage, and the valve core member is sealable to at least a part of the wall portion. The first mounting hole passage includes a first sub-passage and a second sub-passage, the first sub-passage is arranged closer to the first hole passage relative to the second sub-passage.

The fluid control assembly further includes a communication hole, the communication hole is arranged between the first sub-passage and the second sub-passage. The fluid flow passage includes the second hole passage, the first hole passage, the first sub-passage, the communication hole, and the second sub-passage. The valve core member includes a core body, the core body is operated under a pressure difference between the first sub-passage and the second sub-passage. In a case that the valve core member is in a valve-opened state, the first sub-passage is in communication with the second sub-passage through the communication hole, and in a case that the valve core member is in a valve-closed state, the first sub-passage is not in communication with the second sub-passage.

In the above technical solution, a heat exchange core, a mounting block and a valve core member is arranged, and at least part of the valve core member is arranged in a first mounting hole passage of the mounting block, and the valve core member is sealable to a wall portion of the first mounting hole passage of the mounting block. In this way, the fluid control assembly includes a fluid flow passage, and the fluid flow passage includes a first port, a second hole passage, a first hole passage, a first sub-passage, a communication hole, a second sub-passage, and a second port. The core body of the valve core member is operated under a pressure difference between the first sub-passage and the second sub-passage, to enable or disable the communication between the first sub-passage and the second sub-passage, so that the flow direction of the fluid flow passage of the fluid control assembly is constant.

DETAILED DESCRIPTION

Figure 1:
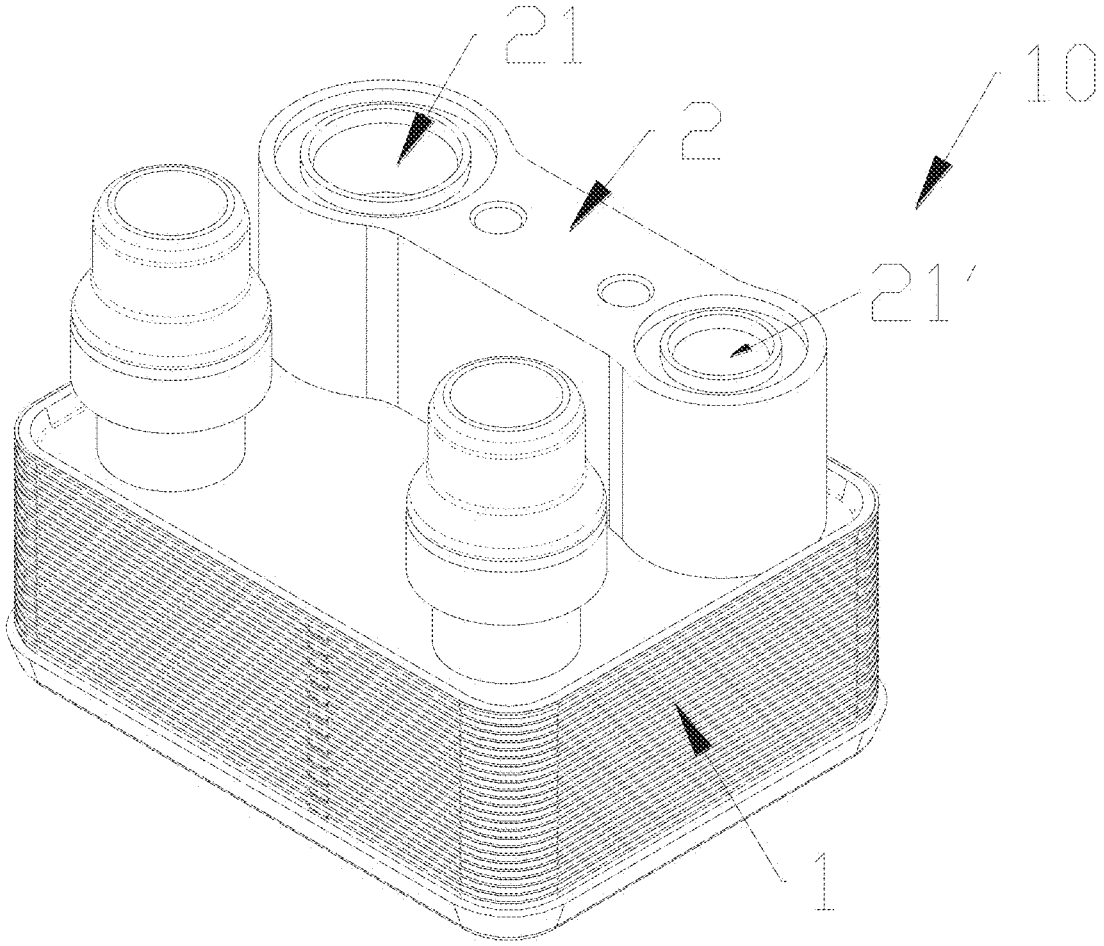
FIG. 1 is a schematic perspective view of a structure of a fluid control assembly according to an embodiment of the present application.
Figure 2:
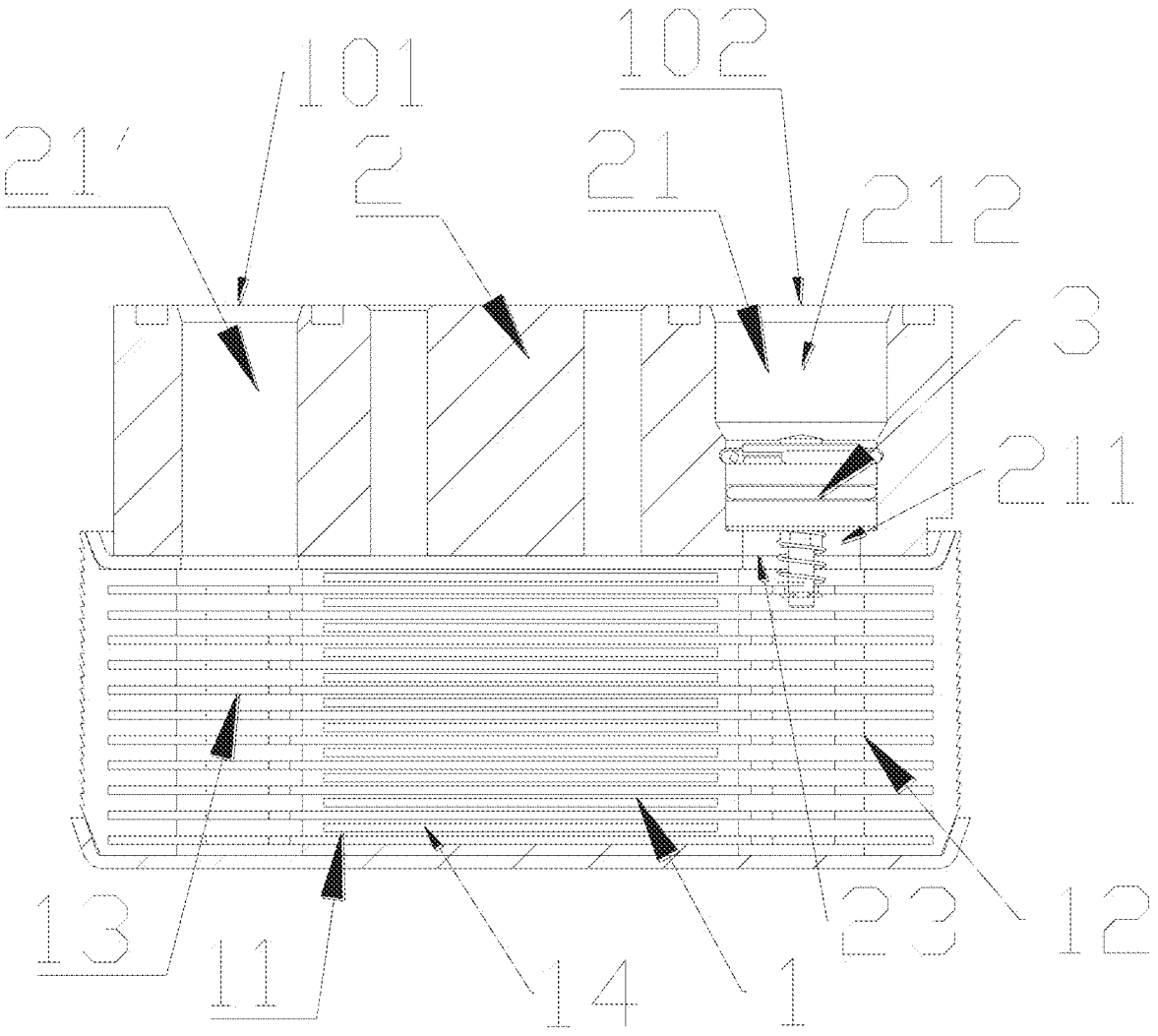
FIG. 2 is a schematic cross-sectional view of the structure shown in FIG. 1.
Figure 3:
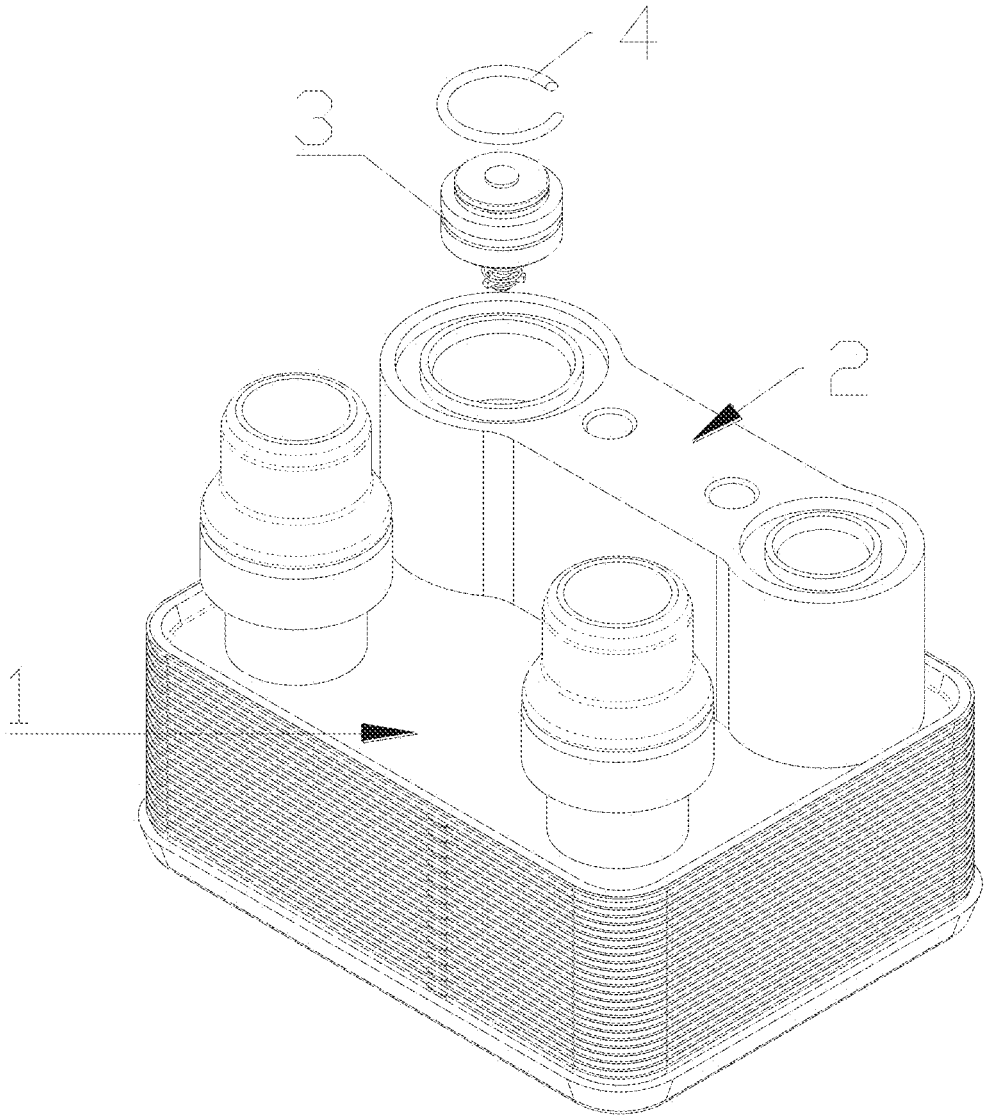
FIG. 3 is a partially exploded view of the structure shown in FIG. 1.

Reference is made to FIGS. 1 to 3, and FIG. 1 shows a structural view of a fluid control assembly that may be applied to an in-vehicle air conditioning system or an in-vehicle thermal management system. The fluid control assembly 10 includes a heat exchange core 1, a mounting block 2 and a valve core member 3. The heat exchange core body 1 and the mounting block 2 are fixed to each other by welding, and the valve core member 3 and the mounting block 2 are arranged in a position limiting manner.

The fluid control assembly 10 includes a first port 101 and a second port 102, a fluid may enter the fluid control assembly 10 from the first port 101 and exit the fluid control assembly 10 from the second port 102 after exchanging heat within the fluid control assembly 10. In a case that the fluid control assembly 10 is applied to a system, a compressor is arranged at a downstream of the fluid control assembly 10, and when reflux occurs due to an on/off operation of the compressor, the fluid control assembly 10 can block the fluid entering from the second port 102 from flowing into an interior of the fluid control assembly 10, such that the fluid entering the fluid control assembly 10 flows in a direction from the first port 101 to the second port 102.

The heat exchange core 1 includes multiple plates, and the plates include a first plate and a second plate. The first plate and the second plate are alternately stacked to form a first flow passage 11 and a second flow passage 14. Except for the outmost two plates, on one side of each of the other plates, a part of the first flow passage 11 is formed, and on the other side of the plate, a part of the second flow passage 14 is formed. For example, the first plate and one of the two second plates adjacent to the first plate form a part of the first flow passage 11, and the first plate and the other second plate form a part of the second flow passage 14. The first flow passage 11 is not in communication with the second flow passage 14. The heat exchange core 1 includes a first hole passage 12 and a second hole passage 13, where the first hole passage 12 and the second hole passage 13 are in communication with the first flow passage 11.

The first flow passage 11 may also be referred to as a fluid flow passage, the fluid in the first flow passage 11 may be a refrigerant, and the fluid in the second flow passage 14 may be a coolant. However, the heat exchange core 1 may also include multiple flow passages, for example, three or four flow passages.

The fluid control assembly 10 includes a valve core member 3, and at least a part of the valve core member 3 is arranged in the first mounting hole passage 21. The first mounting hole passage 21 includes a first sub-passage 211 and a second sub-passage 212, the first sub-passage 211 is arranged closer to the first hole passage 12 relative to the second sub-passage 212, and the first sub-passage 211 is in communication with the first hole passage 12. The valve core member 3 includes a core body, and the core body is operated under a pressure difference between the first sub-passage 211 and the second sub-passage 212. The fluid control assembly 10 includes a valve port. In a case that the valve core member 3 is in a valve-opened state, the first sub-passage 211 is in communication with the second sub-passage 212 through the valve port, and in a case that the valve core member 3 is in a valve-closed state, the first sub-passage 211 is not in communication with the second sub-passage 212.

The mounting block 2 includes a first mounting hole passage 21 and a second mounting hole passage 21'. The first mounting hole passage 21 is in communication with the first hole passage 12, and the second mounting hole passage 21' is in communication with the second hole passage 13. The first mounting hole passage 21, the second mounting hole passage 21' extends through the mounting block 2. The fluid control assembly 10 includes a valve core member 3, and at least a part of the valve core member 3 is arranged in the first mounting hole passage 21. The first mounting hole passage 21 includes a first sub-passage 211 and a second sub-passage 212, the first sub-passage 211 is arranged closer to the first hole passage 12 relative to the second sub-passage 212, and the first sub-passage 211 is in communication with the first hole passage 12. The valve core member 3 is configured to unidirectionally communicate the first sub-passage 211 with the second sub-passage 212 or unidirectionally blocks the first sub-passage 211 from the second sub-passage 212. The term "block" is not limited to indicating a case where a flow rate of the fluid is equal to zero, but also indicating a case where the flow rate of the fluid is within an error range which is considered to be zero. The mounting block 2 includes a first position limiting portion 222, a mounting block cooperating portion 223 and a second position limiting portion 224 that are arranged on a wall portion 22 of the first mounting hole passage 21. The first position limiting portion 222, the mounting block cooperating portion 223 and the second position limiting portion 224 are integrally arranged, and the first position limiting portion 222 and the second position limiting portion 224 are respectively arranged at two sides of the mounting block cooperating portion 223. The valve core member 3 includes a first end wall portion 315 and a valve core cooperating portion 316. The first end wall portion 315 is arranged adjacent to or in contact with the first position limiting portion 222, the valve core cooperating portion 316 and the mounting block cooperating portion 223 are arranged in cooperation with each other, and the valve core cooperating portion 316 is sealed with the mounting block cooperating portion 223. The second position limiting portion 224 and the valve core member 3 are arranged in a position limiting manner. Alternatively, the fluid control assembly 10 further includes a first fixing member 4, the first fixing member 4 and the second position limiting portion 224 are arranged in the position limiting manner, and the first fixing member 4 and the valve core member 3 are arranged in the position limiting manner. In other embodiments, the fluid control assembly includes at least a first fixing member 4 and a second fixing member, the first fixing member 4 and the second position limiting portion 224 are arranged in the position limiting manner, the first fixing member 4 and the valve core member 3 are arranged in the position limiting manner, the second fixing member and the first position limiting portion 222 are arranged in the position limiting manner, and the second fixing member and the first end wall portion 315 are arranged in the position limiting manner. Herein, although the structures of the first position limiting portion 222 and the second position limiting portion 224 in the above embodiment are illustrated to be different from each other, it can be understood that the first position limiting portion 222 and the second position limiting portion 224 may also be arranged to have a similar or identical structure. Although the drawings do not illustrate an embodiment in which the first fixing member 4 and the second fixing member are arranged, it should be understood that various embodiments in which the first fixing member 4 is arranged are also applicable to the second fixing member.

The first position limiting portion 222 protrudes toward the center of the first mounting hole passage 21 with respect to the wall portion 22 of the first mounting hole passage 21, and the first position limiting portion 222 may be in the form of a step or a bevel wall.

The mounting block cooperating portion 223 extends from the first position limiting portion 222 to the second position limiting portion 224. The mounting block cooperating portion 223 includes a flat portion 35 and a groove portion 33, and the flat portion 35 is in cooperation with the valve core cooperating portion 316. The fluid control assembly 10 includes a seal ring 34 that is arranged at the groove portion 33. The arrangement in which the valve core cooperating portion 316 is sealed with the mounting block cooperating portion 223 may be achieved by forming a groove at the valve core member 3 for arranging a seal ring, or by forming a groove at the wall portion 22 of the first mounting hole passage 21 for arranging a seal ring. More specifically, the mounting block 2 has an integrally formed structure. The integrally formed structure and the integral arrangement described herein indicate integrally processed structures that are formed by, for example, a die casting process, an injection molding process, or a demolding process.

As another embodiment, the mounting block cooperating portion 223 may be arranged at a position between the first position limiting portion 222 and the second position limiting portion 224.

Herein, the positioning portion includes a positioning surface, a positioning line or a positioning point, and the term "positioning" indicates the positioning between the first end wall portion/side wall portion with respect to a member with which it is cooperated. The first position limiting portion 222, the mounting block cooperating portion 223 and the second position limiting portion 224 are integrally arranged, so that the cooperating position of the mounting block 2 and the core body are integrally arranged, thereby reducing a risk of leakage caused by welding during assembling, thus improving seal property of the assembly.

Figure 4:
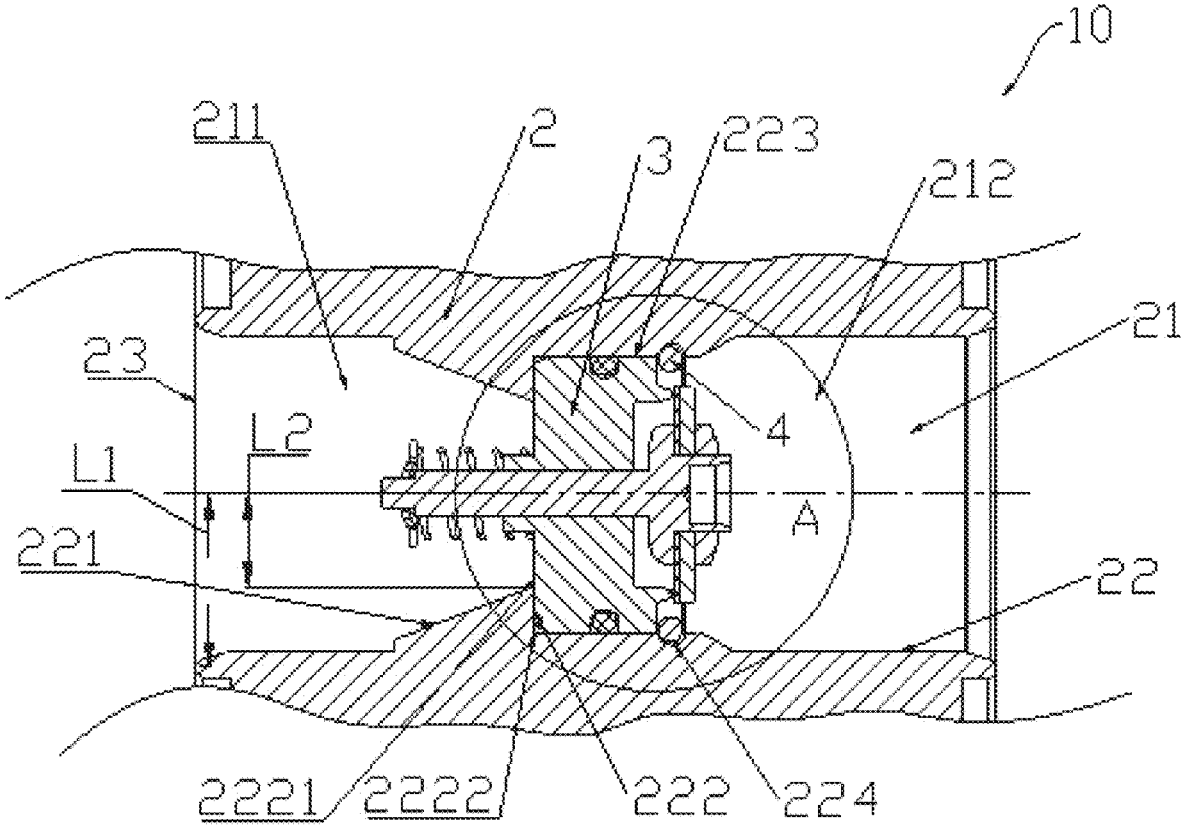
FIG. 4 is a partially cross-sectional view of a structure of a fluid control assembly according to another embodiment.
Figure 5:
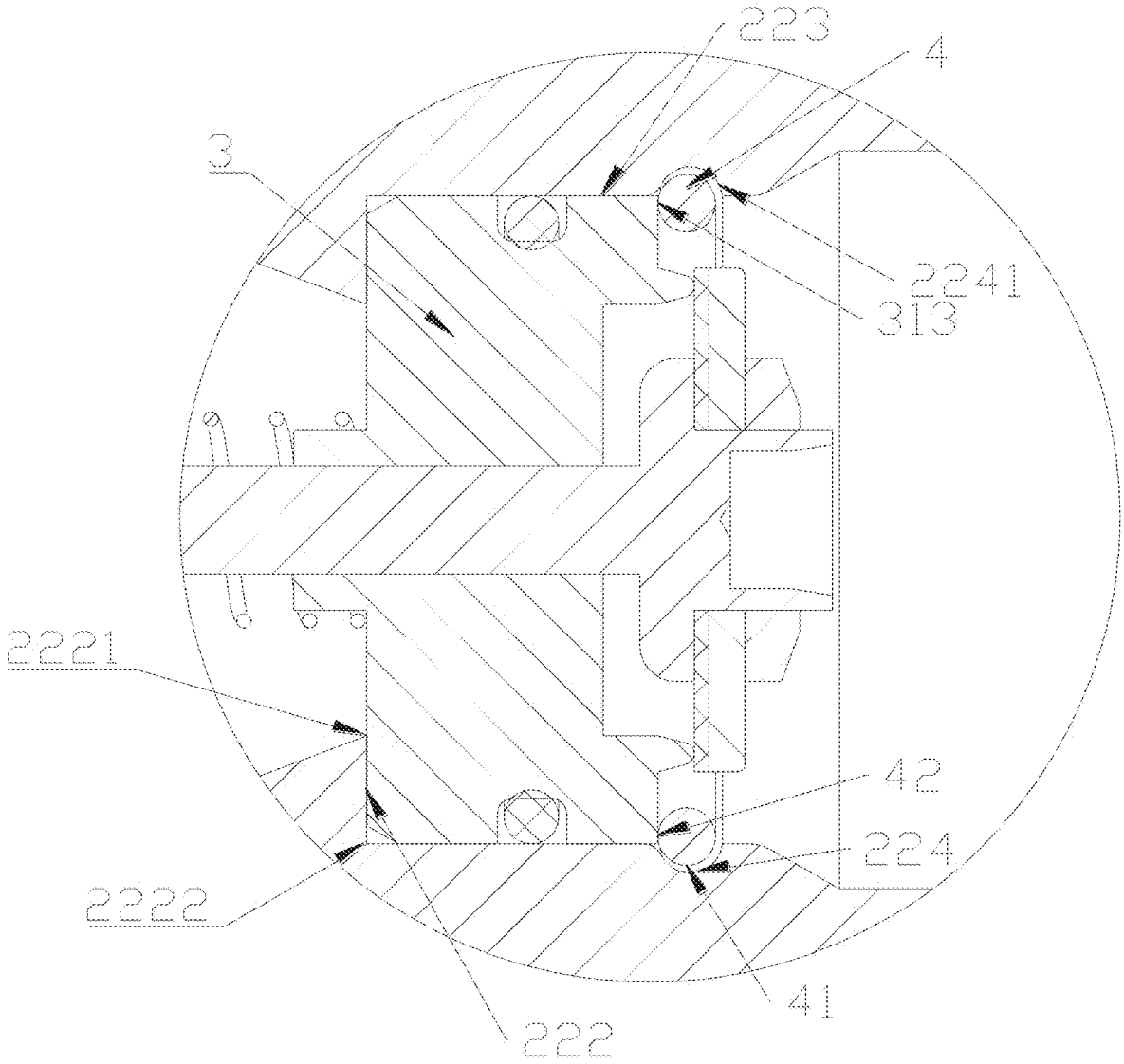
FIG. 5 is an enlarged schematic view of a portion A shown in FIG. 4.
Figure 6:
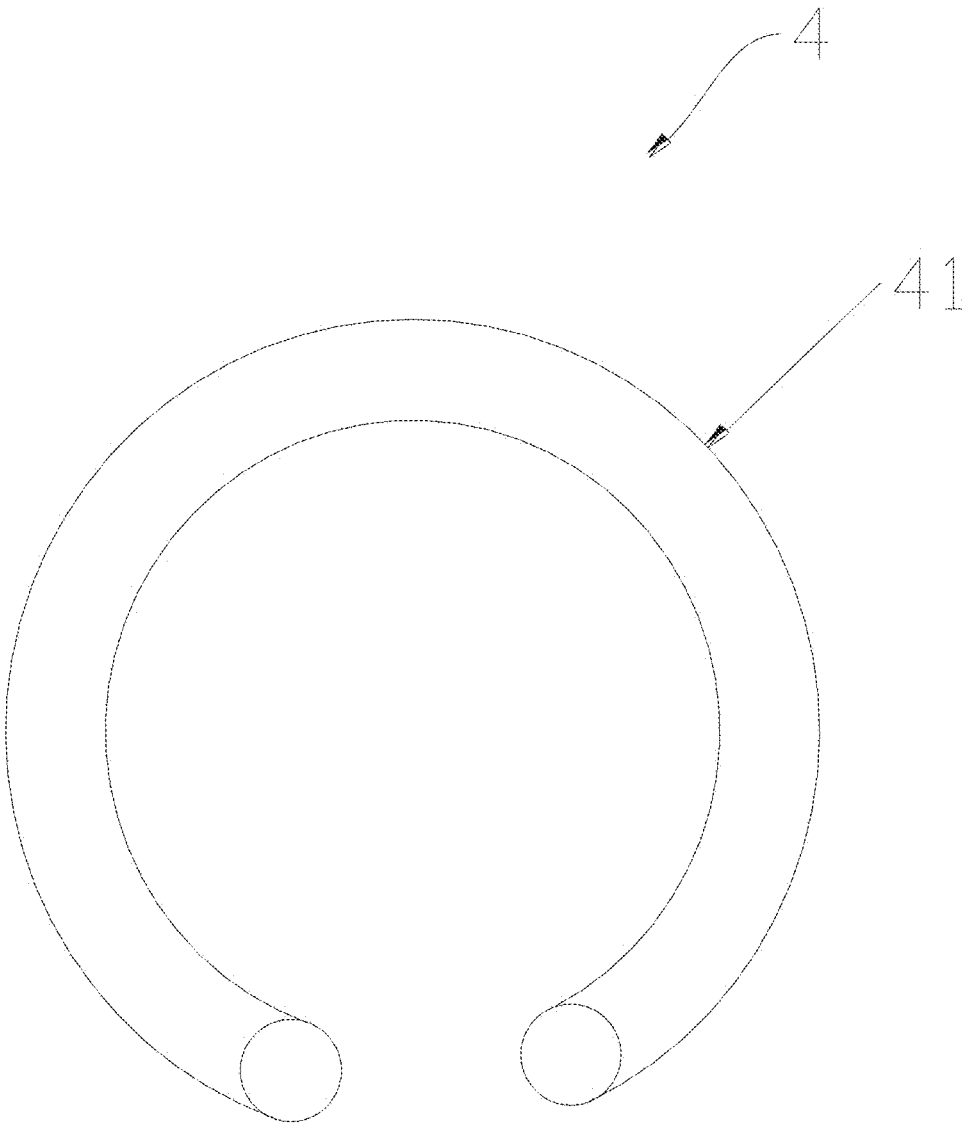
FIG. 6 is a schematic view showing a structure of a first fixing member shown in FIG. 4.

As an embodiment, referring to FIGS. 4, 5 and 6, the fluid control assembly 10 includes a first fixing member 4. The second position limiting portion 224 includes a structure in a form of a slot or a hole, and at least a part of the first fixing member 4 is arranged at the second position limiting portion 224. The first fixing member 4 includes a circumferential side portion 41 and a side wall portion 42. The valve core member 3 includes a second end wall portion 313, the second end wall portion 313 is arranged farther away from the first hole passage 12 relative to the first end wall portion 315. The circumferential side portion 41 of the first fixing member 4 is arranged opposite to the second position limiting portion 224, and the circumferential side portion 41 abuts against the second position limiting portion 224 (in order to clearly show structures of the circumferential side portion 41 and the second position limiting portion 224, in FIG. 5, a gap is arranged between the circumferential side portion 41 and the second position limiting portion 224). At least a part of the side wall portion 42 of the first fixing member 4 is arranged face to the second end wall portion 313 of the valve core member 3, and at least part of the side wall portion 42 abuts against or is arranged adjacent to the second end wall portion 313. Herein, the adjacent arrangement indicates a case that two members are arranged in contact with each other or close to each other (that is, the two members do not apply force to each other) or a case that there is a certain distance between the two members.

More specifically, at least a part of the circumferential side portion 41 abuts against a bottom wall of the slot or the hole. At least a part of the side wall portion 42 is arranged in the slot or the hole.

Figure 7:
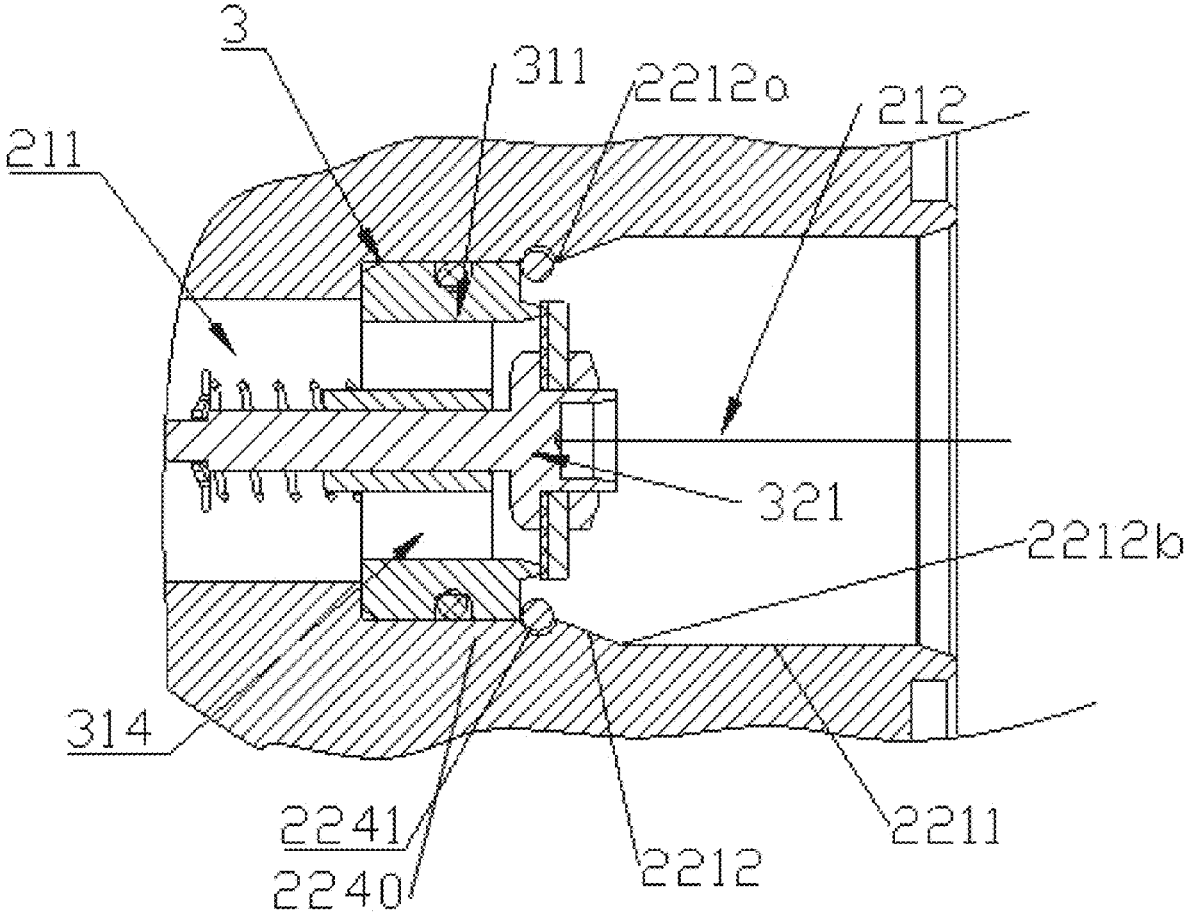
FIG. 7 is a partially cross-sectional view showing a structure of a structure of a fluid control assembly according to another embodiment.

As shown in FIGS. 6 and 7, the first fixing member 4 is in the form of an annular ring with an opening, that is, the first fixing member 4 may maintain a specific rigidity at a certain diameter. At least a part of the circumferential side portion 41 of the first fixing member 4 is arranged opposite to and abuts against the bottom wall portion 2240 of the positioning slot 2241.

More specifically, the first fixing member 4 is in the form of a retaining ring, and the second position limiting portion 224 includes a positioning slot 2241. The inner diameter of the positioning slot 2241 is larger than the outer diameter of the valve core member 3, and at least a part of the circumferential side portion 41 of the first fixing member 4 is arranged opposite to and abuts against the bottom wall portion 2240 of the positioning slot 2241. During assembling, the mounting block 2 and the core body are first fixed by furnace welding, and then the valve core member 3 is arranged in the mounting block and is limited by the first fixing member 4. In this way, the assembling is performed conveniently, the mounting block 2 and the core body are fixed by furnace welding, such that the formed structure of the mounting block 2 and the core body is stable, and the seal property of the flow passage is tightly, which facilitates improving the stability of the whole structure.

Referring to FIG. 7, the mounting block 2 includes a first wall section 2211 and a second wall section 2212 that are arranged on the wall portion 22 of the first mounting hole passage 21, and the second wall section 2212 connects the first wall section 2211 with the positioning slot 2241, the second wall section 2212 is reduced in diameter relative to the first wall section 2211 along an axial direction of the first mounting hole passage 21 from the first wall section 2211 to the positioning slot 2241. The second wall section 2212 includes a first portion 2212*a* and a second portion, the first portion 2212*a* is connected to the positioning slot 2241, the second portion 2212*b* is connected to the first wall section 2211, and a distance between the first portion 2212*a* and an axis of the first mounting hole passage 21 is smaller than a distance between a bottom wall portion 2240 of the positioning slot 2241 and the axis of the first mounting hole passage 21. In this case, during assembling, a mounting tool is sleeved into the first mounting hole passage 21, and the mounting tool is sleeved to reach the position of the second wall section 2212, and the first fixing member 4 is placed in the mounting tool, then the first fixing member 4 is pushed into the positioning slot 2241 through the mounting tool.

Figure 8:
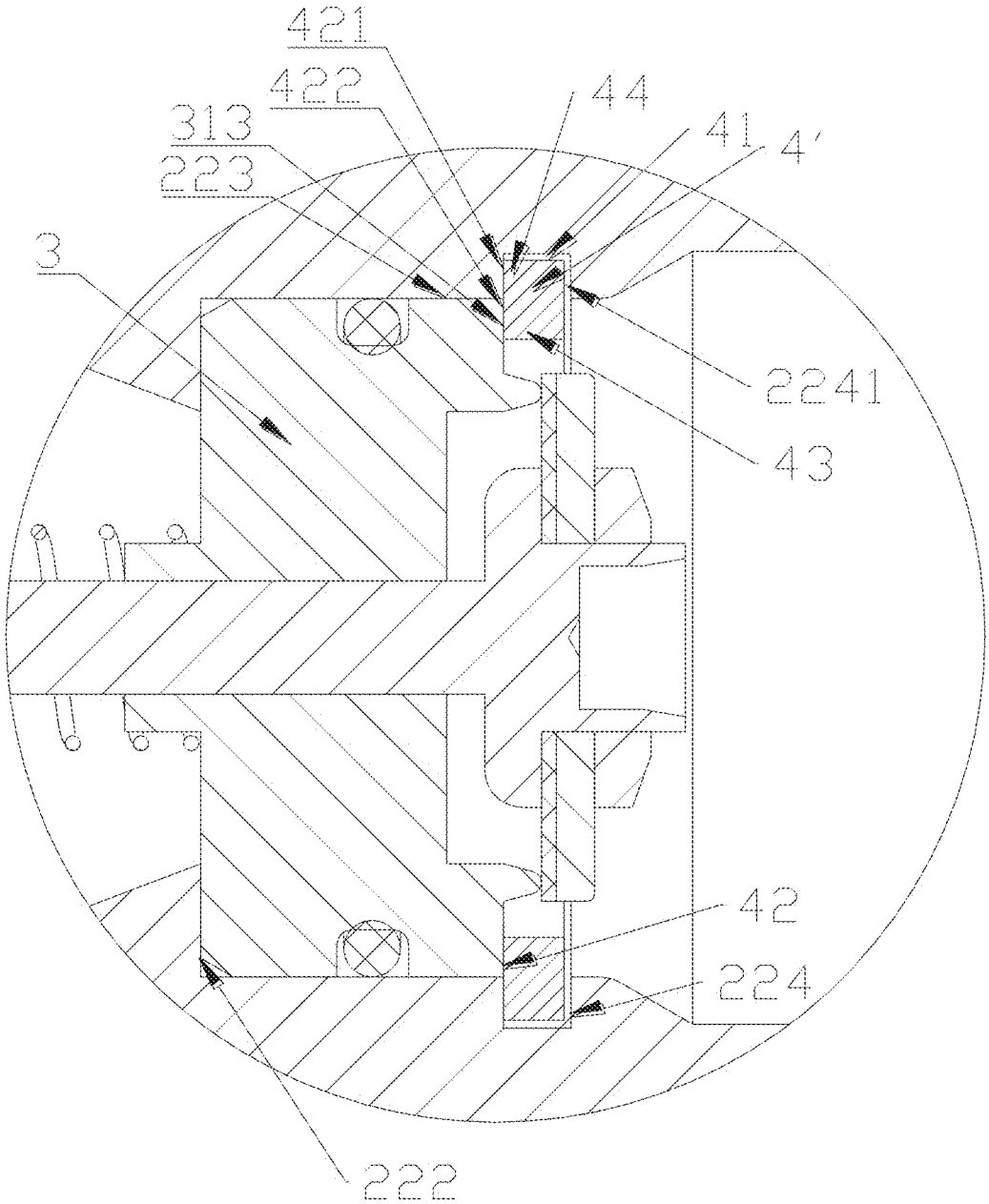
FIG. 8 is an enlarged schematic view of the portion A shown in FIG. 4 according to another embodiment of the present application.
Figure 9:
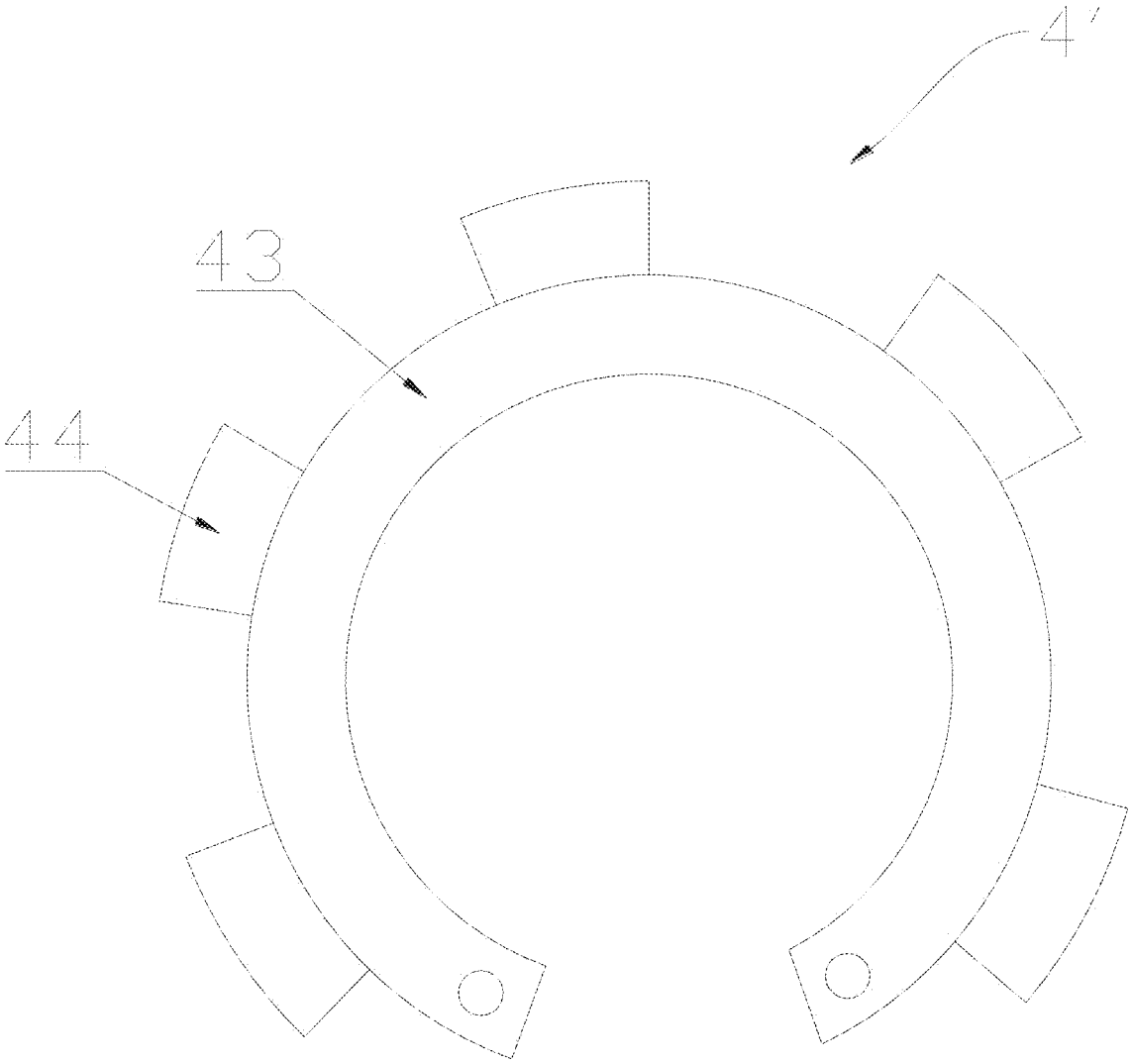
FIG. 9 is a schematic view showing a structure of a first fixing member shown in FIG. 8.

As another embodiment, referring to FIGS. 8 and 9, the second position limiting portion 224 includes at least two positioning slots 2241, and the first fixing member 4' includes a body portion 43 and at least two convex portions 44, the convex portions 44 are radially arranged at an outer circumference of the body portion 43, each of the convex portions 44 is arranged in cooperation with the positioning slot 2241, and at least a part of the convex portion 44 is arranged in the positioning slot 2241. The circumferential side portion 41 of the first fixing member 4' is arranged at the convex portions 44, at least a part of the circumferential side portion 41 is arranged opposite to and abuts against the second position limiting portion 224. The side wall portion 42 of the first fixing member 4' includes a first positioning sub-portion 421 and a second positioning sub-portion 422, the first positioning sub-portion 421 is arranged in the convex portion, the second positioning sub-portion 422 is arranged at the body portion 43, and the second positioning sub-portion portion 422 is arranged opposite to and abuts against the second end wall portion 313.

Figure 10:
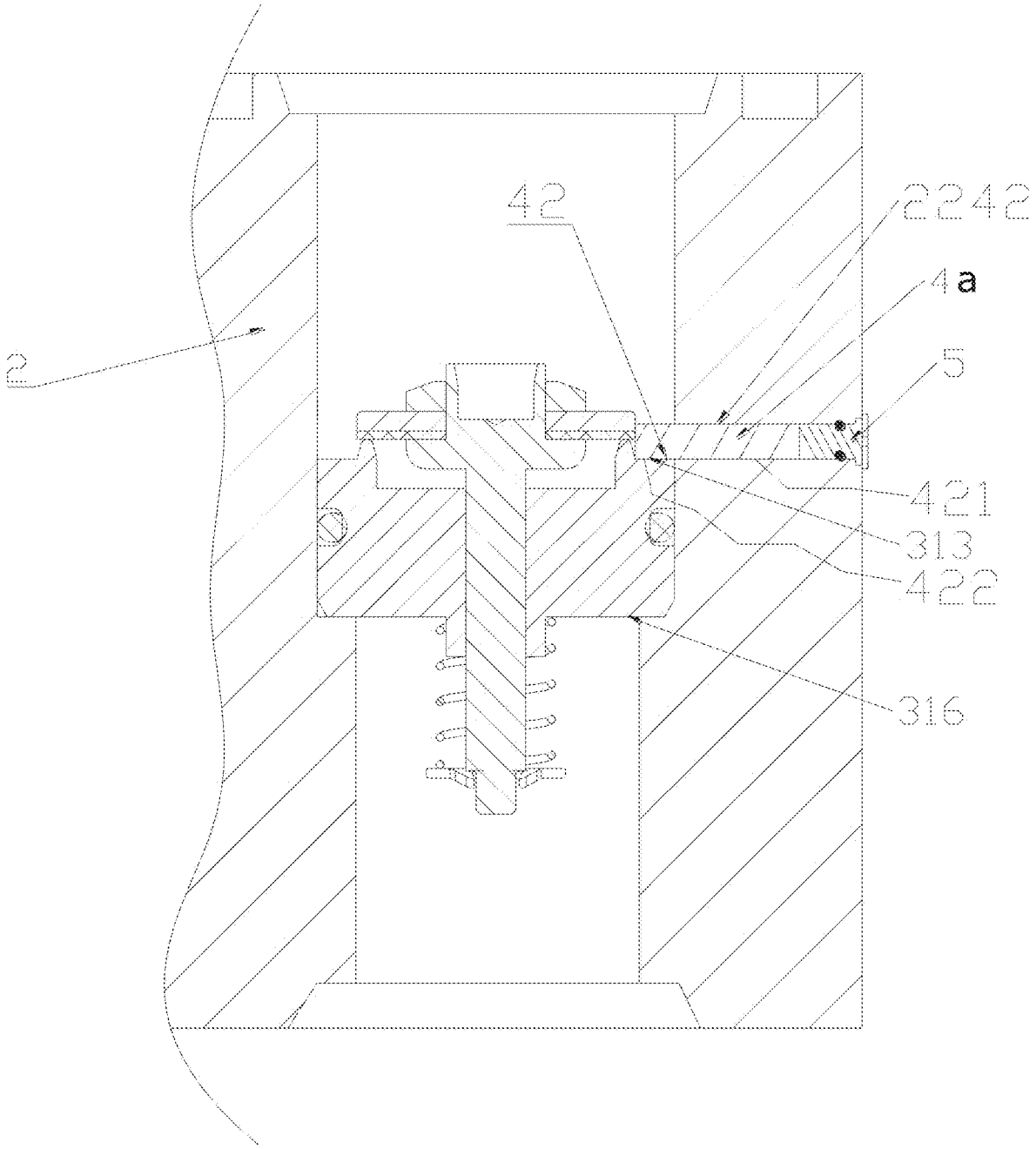
FIG. 10 is a partially cross-sectional view of a structure of a fluid control assembly according to yet another embodiment of the present application.
Figure 11:
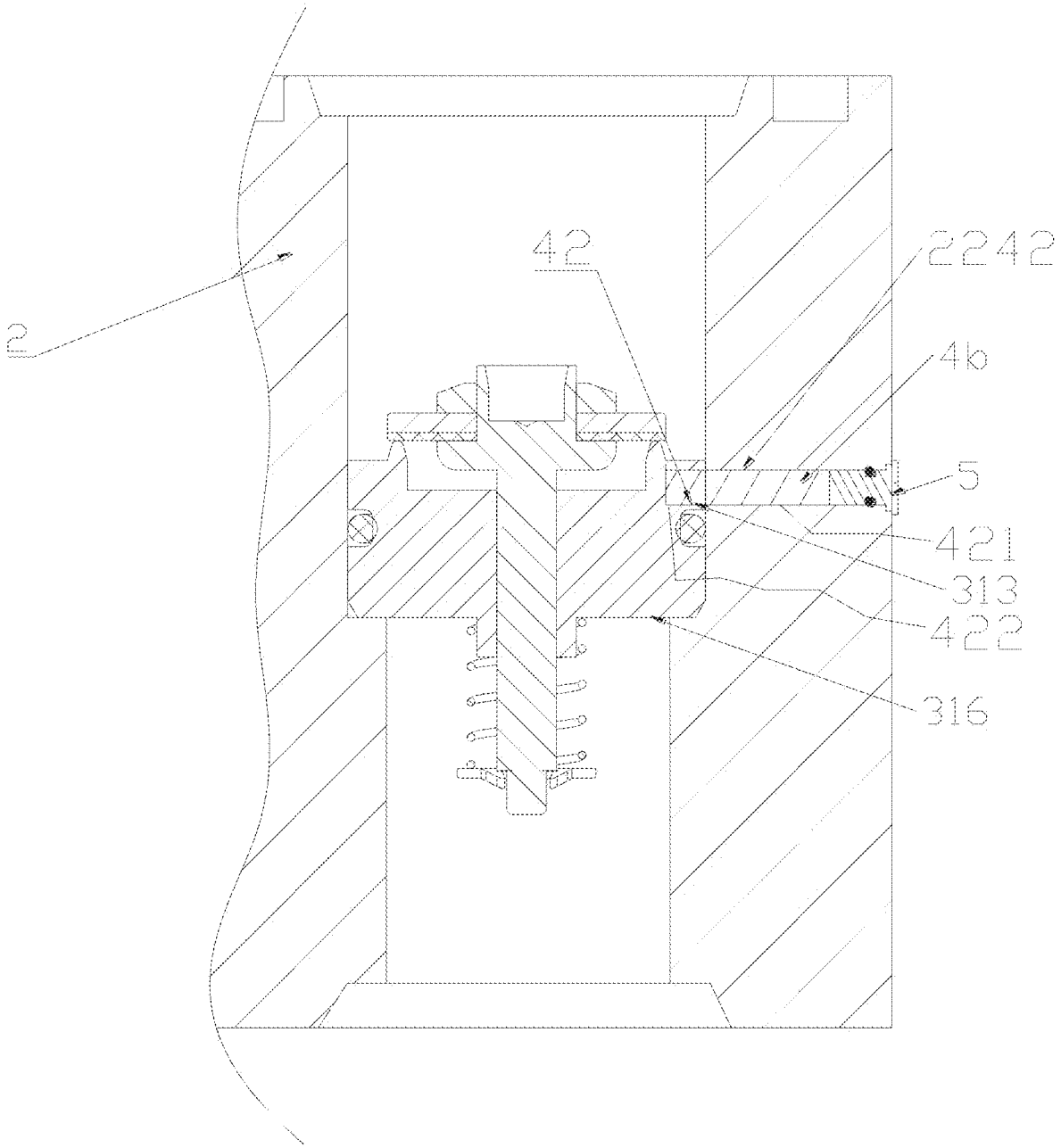
FIG. 11 is a partially cross-sectional view of a structure of a fluid control assembly according to still another embodiment of the present application.

As another embodiment, referring to FIGS. 10 and 11, the first fixing members 4*a*, 4*b* are in the form of a pin or a pressing plate, and the second position limiting portion 224 includes at least two positioning holes 2242, and the number of the first fixing members 4*a*, 4*b* is two or more, at least a part of each of the first fixing members 4*a*, 4*b* is arranged in the positioning hole 2242. The first fixing members 4*a*, 4*b* each includes a side wall portion 42, and the side wall portion 42 includes a first positioning sub-portion 421 and a second positioning sub-portion 422, the first positioning sub-portion 421 is arranged in the positioning hole 2242, and the second positioning sub-portion 422 is arranged opposite to and abuts against the second end wall portion 313. It should be understood that, as shown in FIGS. 10 and 11, the position where each of the first fixing members 4*a*, 4*b* is provided with the second positioning sub-portion 422 may be located outside the valve core member 3 or may be located inside the valve core member 3.

More specifically, the fluid control assembly 10 further includes a seal member 5, and at least a part of the seal member 5 is arranged in the positioning hole 2242, and the positioning hole 2242 is a through hole. A part of each of the first fixing members 4*a*, 4*b* is arranged opposite to the second end wall portion 313, and the other part of each of the first fixing members 4*a*, 4*b* extents into the positioning hole 2242, and at least a part of the first fixing members 4*a*, 4*b* abuts against the seal member 5, and the seal member 5 is sealed to the wall portion of the mounting block 2 that forms the positioning hole 2242, for example, by providing a seal ring at the outer circumference of the seal member. The arrangement of the seal member facilitates ensuring the seal property of the positioning hole, thereby preventing fluid from being leaked through the positioning hole.

Figure 12:
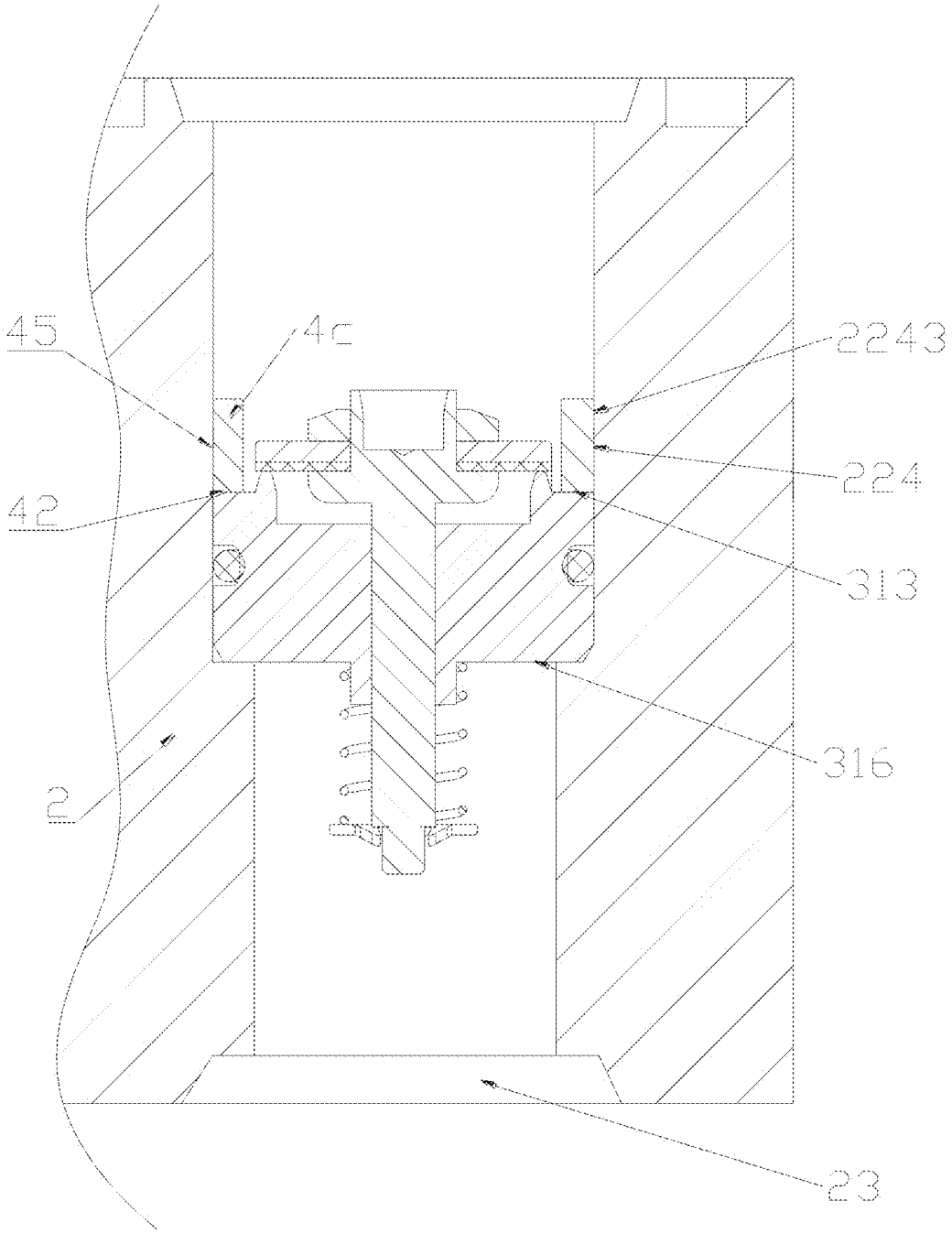
FIG. 12 is a partially cross-sectional view of a structure of a fluid control assembly according to yet another embodiment of the present application.

As another embodiment, referring to FIG. 12, the second position limiting portion 224 includes a threaded section 2243. The valve core member 3 includes a second end wall portion 313, and the second end wall portion 313 is arranged farther away from the first hole passage 12 relative to the first end wall portion 315. Along the axial direction of the first mounting hole passage 21, an end of the threaded section 2243 extends from a position flushing with the second end wall portion 313 toward a direction away from the first hole passage 12. The fluid control assembly 10 includes a first fixing member 4*c* having a threaded portion 45 that is arranged in cooperation with the threaded section 2243, and the first fixing member 4*c* includes a side wall portion 42, which abuts against the second end wall portion 313.

Figure 13:
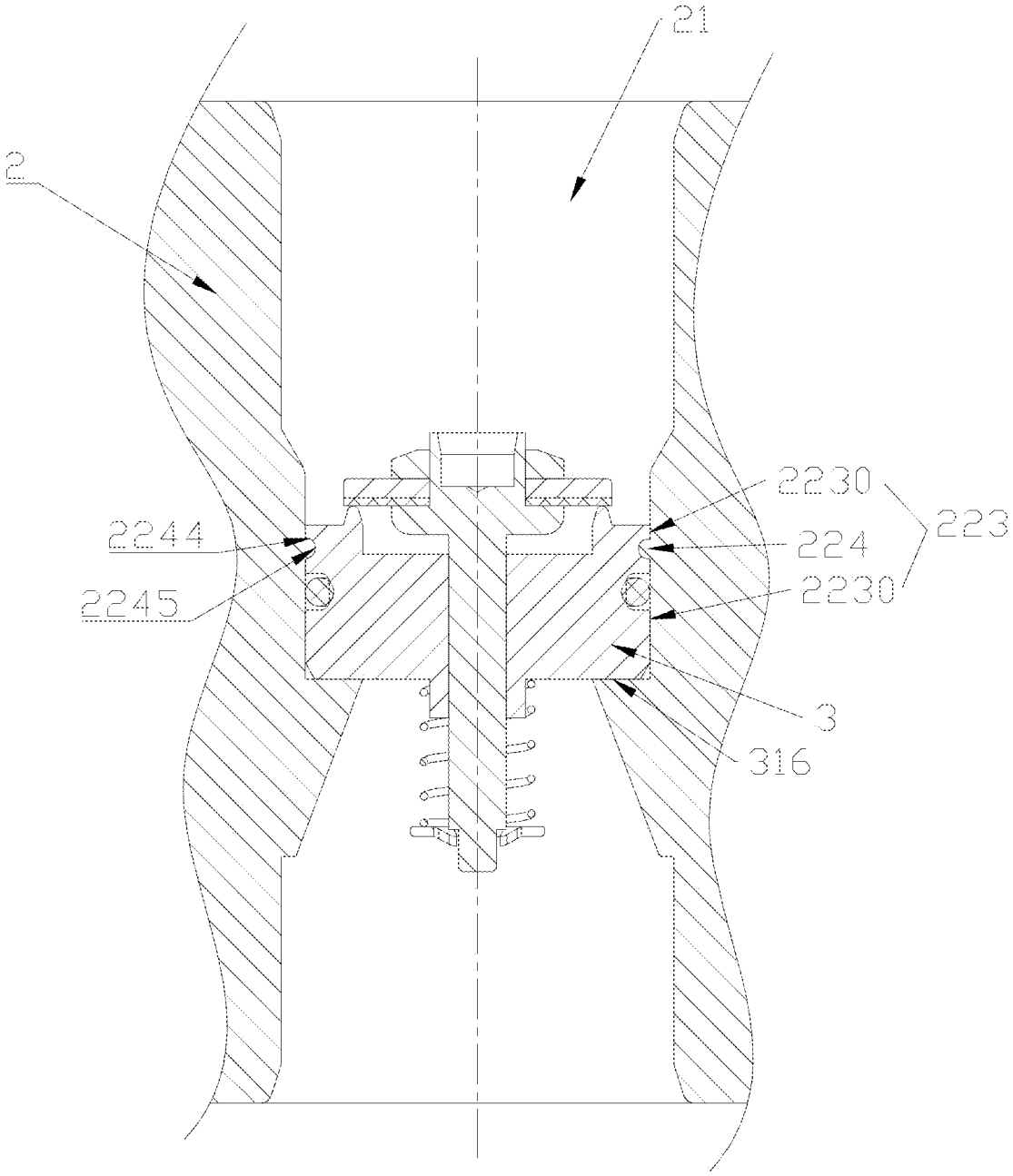
FIG. 13 is a partially cross-sectional view of a structure of a fluid control assembly according to another embodiment of the present application.
Figure 14:
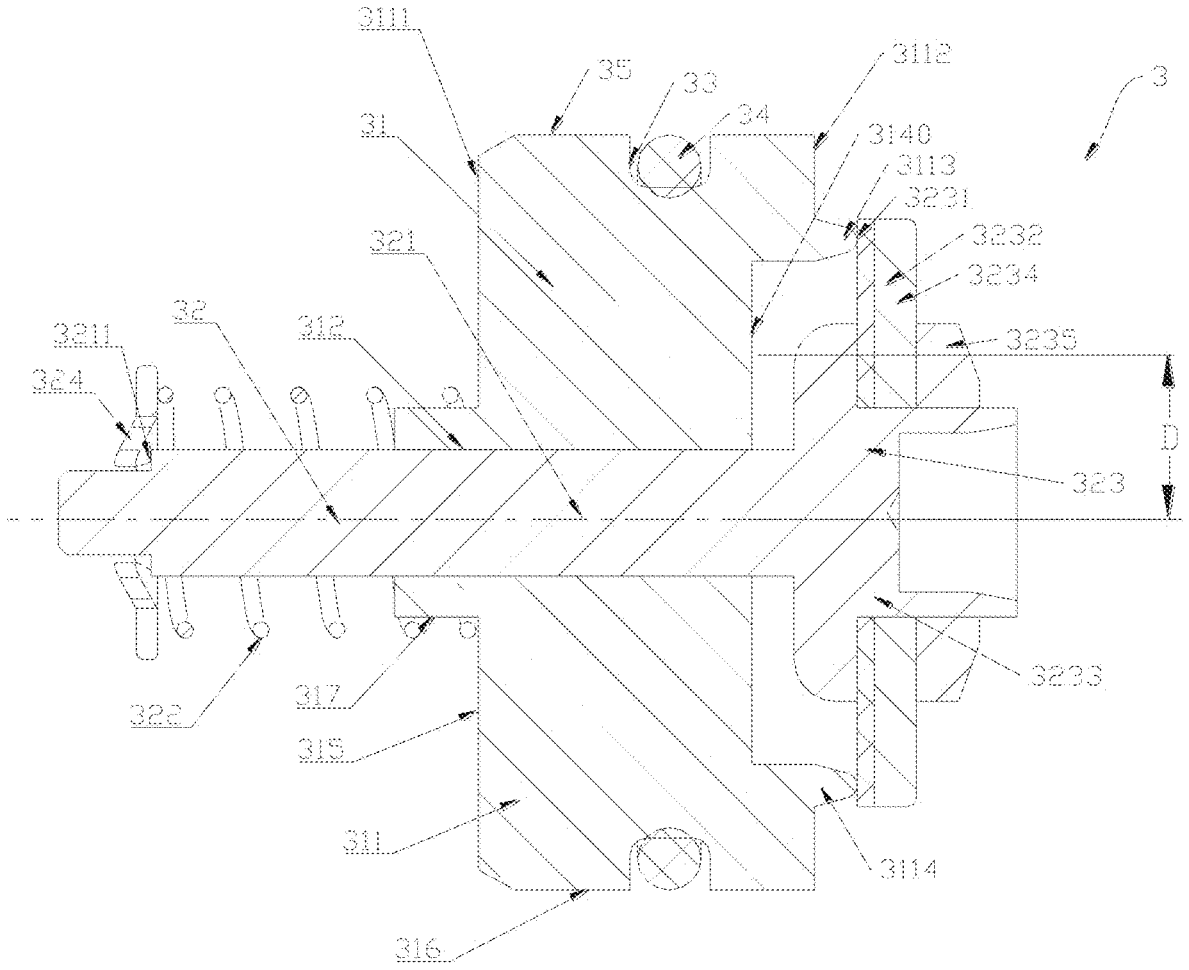
FIG. 14 is a schematic view showing a structure of a valve core member shown in FIG. 4.
Figure 15:
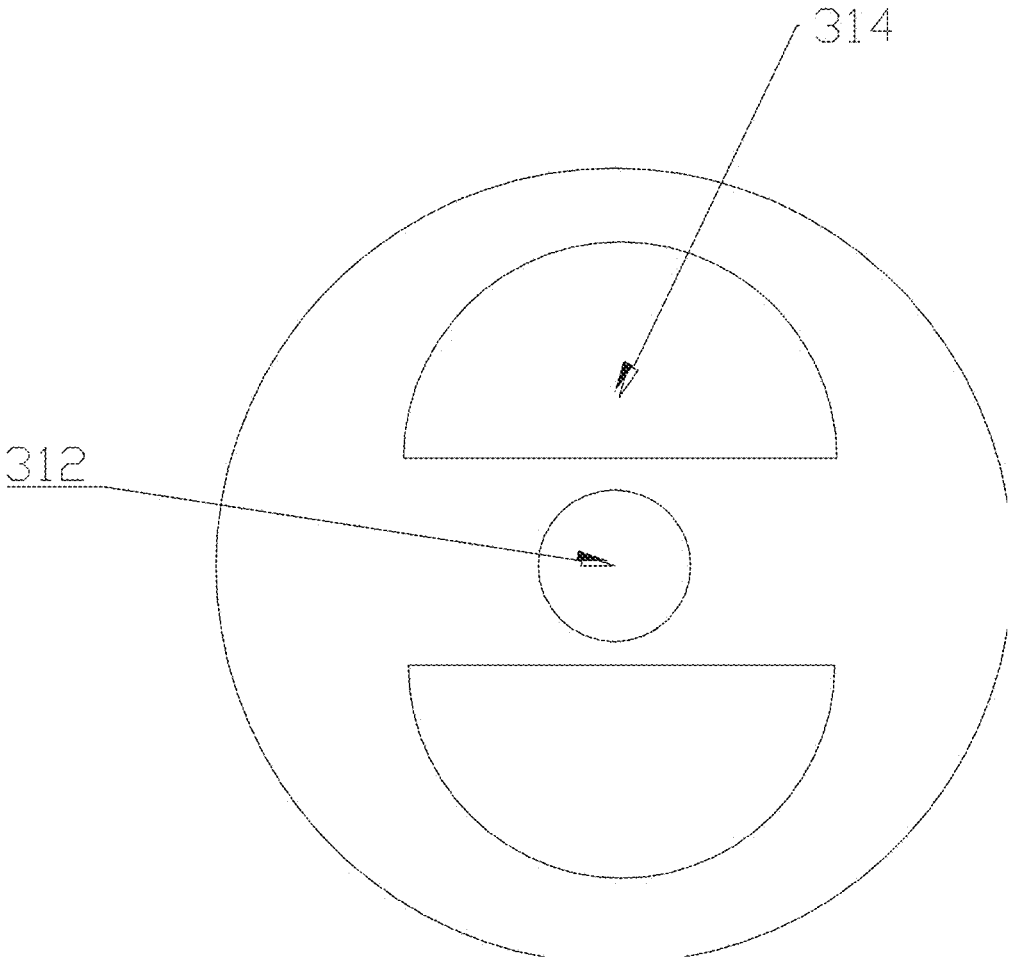
FIG. 15 is a top view of a core body shown in FIG. 4, in which a convex structure is omitted to more clearly highlight a structure of a flow hole.

As another embodiment, referring to FIG. 13, along the axial direction of the first mounting hole passage 21, the mounting block cooperating portion 223 includes at least two sub-cooperating portions 2230, and the second position limiting portion 224 is arranged between the sub-cooperating portions 2230. The second position limiting portion 224 includes at least one convex portion 2244 protruding toward a center line direction of the first mounting hole passage 21, and a distance between a bottom 2245 of the convex portion 2244 and a center line of the first mounting hole passage 21 is smaller than a distance between the sub-cooperating portion 2230 adjacent to the second position limiting portion 224 and the center line of the first mounting hole passage 21.

According to the above embodiment, the valve core member 3 of a one-way valve may be integrated to the mounting block 2, which reduces the number of connectors for connecting the one-way valve and the heat exchange core 1 and attached parts, thereby reducing the production cost and the mounting cost. In addition, according to the above embodiment, the mounting is performed simple, time-saving, and reliable, thereby reducing a risk of leakage due to pipe connection and the pressure loss due to additional sealing connection, thus reducing the possibility of generating noise by the fluid. In addition, the valve core member 3 and the mounting block 2 are fixedly arranged, which facilitates increasing the strength of the fluid control assembly 10, and realizes a compact structure.

The mounting block 2 further includes a third wall section arranged on the wall portion 22 of the first mounting hole passage 21, the third wall section is arranged close to the heat exchange core 1, the first wall section 2211 is arranged close to the second port 102, and the inner diameter of the third wall section is smaller than the inner diameter of the first wall section 2211, and the inner diameter of the third wall section is larger than the outer diameter of the valve core member 3. Since the mounting block 2 and the heat exchange core 1 are fixed by welding, in order to ensure the structure of the valve core member 3, the valve core member 3 is assembled after welding, so that the valve core member 3 may be assembled from the second port 102, which facilitates compact structure and convenient assembly.

Referring to FIGS. 4, 5, 14, and 15, the valve core member 3 includes a core body 31 and a movable rod assembly 32. The core body 31 is positioned inside the first mounting hole passage 21, and the movable rod assembly 32 is movable relative to the core body 31 in the axial direction, where the term "axial direction" is defined as a direction in which the first mounting hole passage 21 extends. The core body 31 includes a communication hole 314, and the communication hole 314 is arranged between the first sub-passage 211 and the second sub-passage 212. The movable rod assembly 32 is arranged in cooperation with the core body 31 to block the communication hole 314 from the second sub-passage 212 or to communicate the communication hole 314 with the second sub-passage 212. Specifically, the core body 31 is provided with a first central through hole 312, and the movable rod assembly 32 extends into the first central through hole 312 and is movable relative to the core body 31 in the axial direction, to allow the valve core member 3 to block the first sub-passage 211 from the second sub-passage 212 or to communicate the first sub-passage 211 with the second sub-passage 212.

The valve core member 3 includes a core body 31 and a movable rod assembly 32. The core body 31 is positioned inside the mounting hole passage, and the movable rod assembly 32 is movable relative to the core body 31 in the axial direction. The core body 31 is provided with the second end wall portion 313, the first fixing member 4 includes a second central through hole, and the first fixing member is sleeved outside the movable rod assembly 32, and at least a part of the side wall portion 42 abuts against or is arranged adjacent to the second end wall portion 313.

In a specific embodiment, the first end wall portion 315 and the valve core cooperating portion 316 are arranged in the core body 31. The core body 31 is provided with at least two communication holes 314, the communication hole 314 is in communication with the first sub-passage 211, and the movable rod assembly 32 is configured to block the communication hole 314 from the second sub-passage 212 or to communicate the communication hole 314 with the second sub-passage 212.

More specifically, the core body 31 includes a base portion 311 and a convex portion 317, the base portion 311 includes a first side portion 3111 and a second side portion 3112, the first side portion 3111 is arranged closer to the port 23 relative to the second side portion 3112, the convex portion 317 protrudes from the first side portion 3111 of the base portion 311 toward the port 23, and the base portion 311 is arranged in cooperation with the wall portion 22 of the first mounting hole passage 21.

The port 23 belongs to the mounting block, and the port 23 is arranged at a connection position of the heat exchange core 1 and the mounting block 2.

The communication holes 314 are arranged at the base portion 311. The communication hole 314 penetrates through the base portion 311, and the communication hole 314 is in communication with the first sub-passage 211. The communication holes 314 are distributed at the circumference of the first central through hole 312. The base portion 311 includes a valve port 3140, and the valve port 3140 is arranged at the second side portion 3112 of the base portion 311. The valve port 3140 is defined as a port of the communication hole 314, and the distance between a center line of the valve port 3140 and a center line of the first central through hole 312 is represented by D.

The movable rod assembly 32 includes a movable rod 321, an elastic member 322 and a protruding portion 323. The elastic member 322 and the protruding portion 323 are respectively arranged on two sides of the movable rod 321 opposite to each other and are respectively arranged at two sides of the core body 31.

The elastic member 322 is sleeved on the outside of a part of the movable rod 321. One end of the elastic member 322 is engaged with the convex portion 317, and another end of the elastic member 322 is limited to the end of the movable rod 321. The elastic member 322 may be compressed or elongated in the axial direction of the movable rod 321, and the movable rod 321 is movable relative to the core body 31. Herein, the end of the movable rod 321 includes the end of the movable rod 321 and a position at a distance from the end, which is not limited to a portion at the end.

The first position limiting portion 222 and the elastic member 322 are arranged at the same side of the valve core member 3. In this way, the fluid from the heat exchange core 1 exerts a force on the elastic member 322, so that the first sub-passage 211 is in communication with the second sub-passage 212, where the same side means that the first position limiting portion 222 and the elastic member 322 are arranged on the same side of the center line of the valve core member 3. The center line of the valve core member 3 includes a center line along the direction of the first mounting hole passage 21 and a center line substantially perpendicular to the direction of the first mounting hole passage 21, and the center line of the valve core member 3 herein refers to the center line substantially perpendicular to the first mounting hole passage 21.

As another embodiment, the movable rod assembly 32 includes a retaining spring 324. A groove 3211 is arranged at an end of the movable rod 321. The retaining spring 324 is limited to the groove 3211, and the end of the elastic member 322 abuts against the retaining spring 324.

The protruding portion 323 has a larger size than the first central through hole 312, and has a first sealing portion 3231, which faces toward the second side portion 3112 of the base portion 311. The second side portion 3112 of the base portion 311 is provided with a second sealing portion 3113, and the first sealing portion 3231 may be arranged in contact with the second sealing portion 3113. A distance between at least a part of the first sealing portion 3231 and a center line of the first central through hole 312 is larger than the distance D between the center line of the valve port 3140 and the center line of the first central through hole 312, such that the first sealing portion 3231 can block the communication between the valve port 3140 and the second sub-passage 212. Herein, the seal between the first sealing portion 3231 and the second sealing portion 3113 may be implemented as a linear seal or a face seal.

It should be understood that the distance between at least a part of the first sealing portion 3231 and the center line of the first central through hole 312 is larger than the distance D between the center line of the valve port 3140 and the center line of the first central through hole 312. In the circumferential direction of the valve core member 3, a part of the first sealing portion 3231 has a larger distance from the center line of the first central through hole 312 than the valve port 3140 and a part of the first sealing portion 3231 has a smaller or the same distance from the center line of the first central through hole 312 than the valve port 3140.

More specifically, protrusions 3114 are arranged on the second side portion 3112 of the base portion 311. The protrusions 3114 are arranged at the outer circumference of the valve port 3140, and the protrusion 3114 is arranged in cooperation with the first sealing portion 3231. In a case of no force, the protrusion 3114 abuts against the first sealing portion 3231.

The movable rod 321 has a first position and a second position with respect to the core body 31. In a case that the movable rod 321 is arranged at the first position, the first sealing portion 3231 is arranged in contact with and sealed with the second sealing portion 3113, and the communication hole 314 is not in communication with the second sub-passage 212. In a case that the movable rod 321 is arranged at the second position, a gap is arranged between the first sealing portion 3231 and the second sealing portion 3113, and the communication hole 314 is in communication with the second sub-passage 212.

The protruding portion 323 includes a closing portion 3232 and a supporting portion 3233. The closing portion 3232 extends and protrudes circumferentially from the supporting portion 3233, and is provided with the first sealing portion 3231. In an embodiment, the closing portion 3232 and the supporting portion 3233 are integrally arranged, and the closing portion 3232 protrudes from the supporting portion 3233. Herein, the closing portion 3232 means that a sealing function is realized when the closing portion 3232 is arranged in cooperation with other parts, and the closing portion 3232 may have a closing structure of a face-closed form, a line-closed form, a concave-convex structure, or other form that can realize a closing function. In another embodiment, the closing portion 3232 and the supporting portion 3233 are separately arranged. The closing portion 3232 includes a closing member 3234 and a pressing member 3235. The closing member 3234 is provided with a first sealing portion 3231, and the closing member 3234 is sleeved at the end of the supporting portion 3233, and the pressing member 3235 is assembled and fixed with the closing member 3234, for example by riveting. Herein, unless otherwise specified, the integral arrangement means that the members are formed by an integral molding process, the separate arrangement means that the members are formed by separate molding processes, and the separate arrangement is defined for the individual members, and does not exclude a case that the members are assembled to form an integral structure.

Referring to FIG. 4, the port 23 is arranged in communication with the first hole passage 12, and the first position limiting portion 222 has an inner side 2221 and an outer side 2222, where the inner side and the outer side are defined relative to the center line of the first mounting hole passage 21. Herein, the inner side of the first position limiting portion 222 is defined to be closer to the center line of the first mounting hole passage 21 relative to the outer side of the first position limiting portion 222. In a specific embodiment, a distance L1 between the wall portion of the mounting block 2 that forms the port 23 and the center line of the first mounting hole passage 21 is larger than a distance L2 between the inner side 2221 of the first position limiting portion 222 and the center line of the first mounting hole passage 21. The mounting block 2 includes a guiding portion 221 arranged on the wall portion 22 of the first mounting hole passage 21, the guiding portion 221 extends from the first position limiting portion 222 toward the port 23. Except for a point connected to the first position limiting portion 222, a distance between each point of the guiding portion 221 and the center line of the first mounting hole passage 21 is larger than the distance L2 between the inner side of the first position limiting portion 222 and the center line of the first mounting hole passage 21. Herein, it is defined that the first mounting hole passage 21 is presented before the valve core member 3 is assembled inside the mounting block 2, and after the valve core member 3 is mounted to the first mounting hole passage 21, the inner side of the first position limiting portion 222 is arranged close to the center line of the first mounting hole passage 21, where the center line of the first mounting hole passage 21 is the center line of the first mounting hole passage 21 before the valve core member 3 is assembled, and the center line of the first mounting hole passage 21 in the present application is understood as the above center line.

The guiding portion 221 extends toward the port 23, which includes a case that the guiding portion 221 extends to the port 23, and also includes a case that the guiding portion 221 extends to a wall portion of the first mounting hole passage 21 that is arranged inside of the port 23.

In another specific embodiment, the distance L1 between the wall portion of the mounting block 2 that forms the port 23 and the center line of the first mounting hole passage 21 is substantially equal to the distance L2 between the inner side 2221 of the first position limiting portion 222 and the center line of the first mounting hole passage 21, with a value range of approximately equal to ±5%.

Referring to FIG. 2, in a case that the fluid control assembly 10 is filled a fluid, the fluid flows into the fluid control assembly 10 from the second mounting hole passage 21' and passes through the second hole passage 13, the first fluid passage 11 and the first hole passage 12. The fluid exerts a force to the movable rod assembly 32, to allow the movable rod assembly 32 to move relative to the core body 31 in the axial direction of the first mounting hole passage 21. The fluid enters the second sub-passage 212 through the communication hole 314 of the valve core member 3 and flows out the fluid control assembly 10 from the second port 102.

In a specific embodiment, at least a part of the valve core member 3 is arranged in the first hole passage 12, which may reduce the height of the mounting block 2, so that the whole structure of the fluid control assembly 10 is small and compact.

In another specific embodiment, the valve core member 3 is arranged in the first mounting hole passage 21, and does not extend into the first hole passage 12, which does not affect the flow direction of the fluid in the heat exchange core 1.

The first hole passage 12 and the second hole passage 13 are arranged at the same side of the heat exchange core 1. Alternatively, the first passage 12 and the second passage 13 may also be respectively arranged at diagonal positions of the heat exchange core 1.

Figure 16:
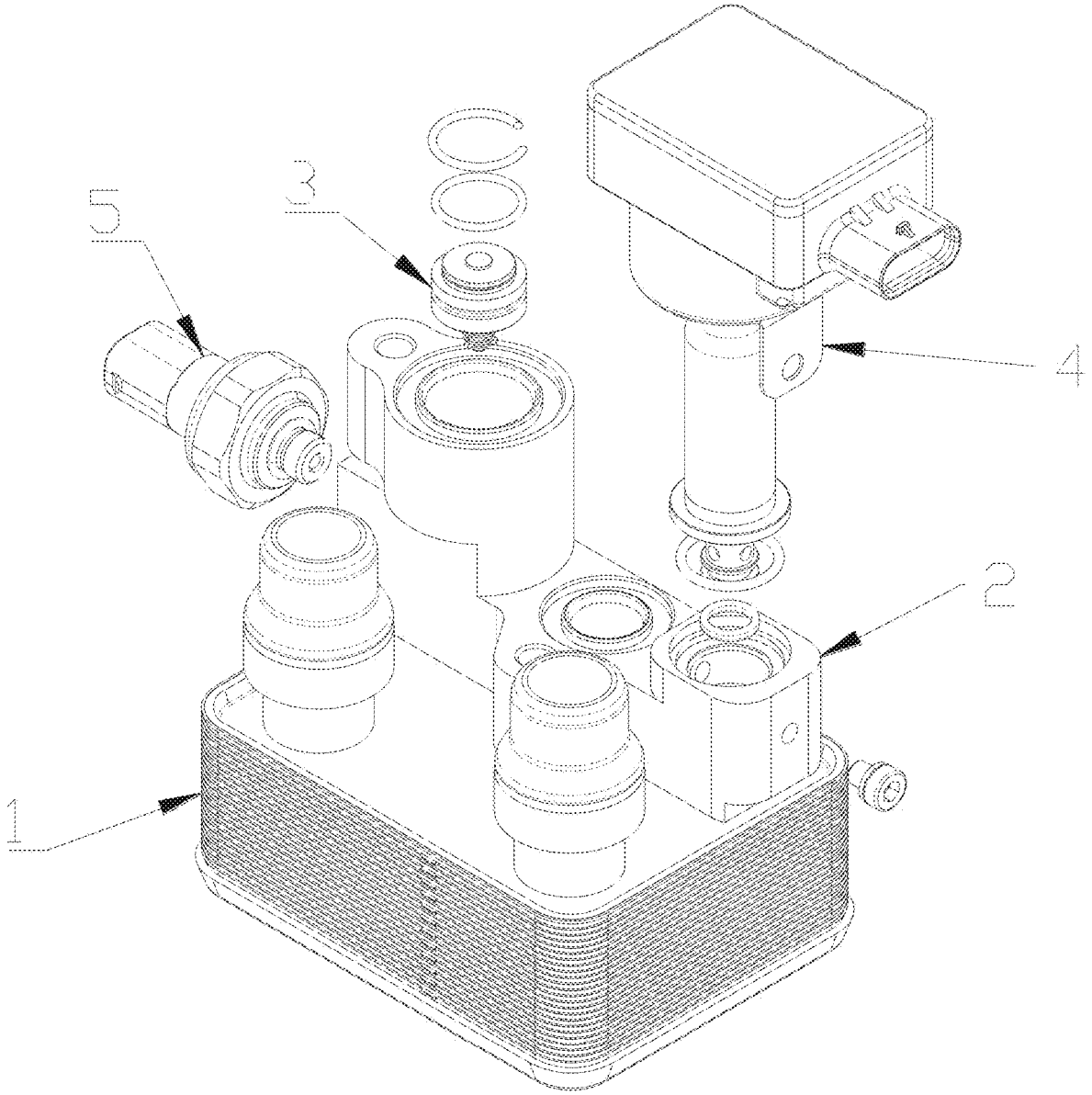
FIG. 16 is a schematic view of a structure of a fluid control assembly according to another embodiment of the present application.
Figure 17:
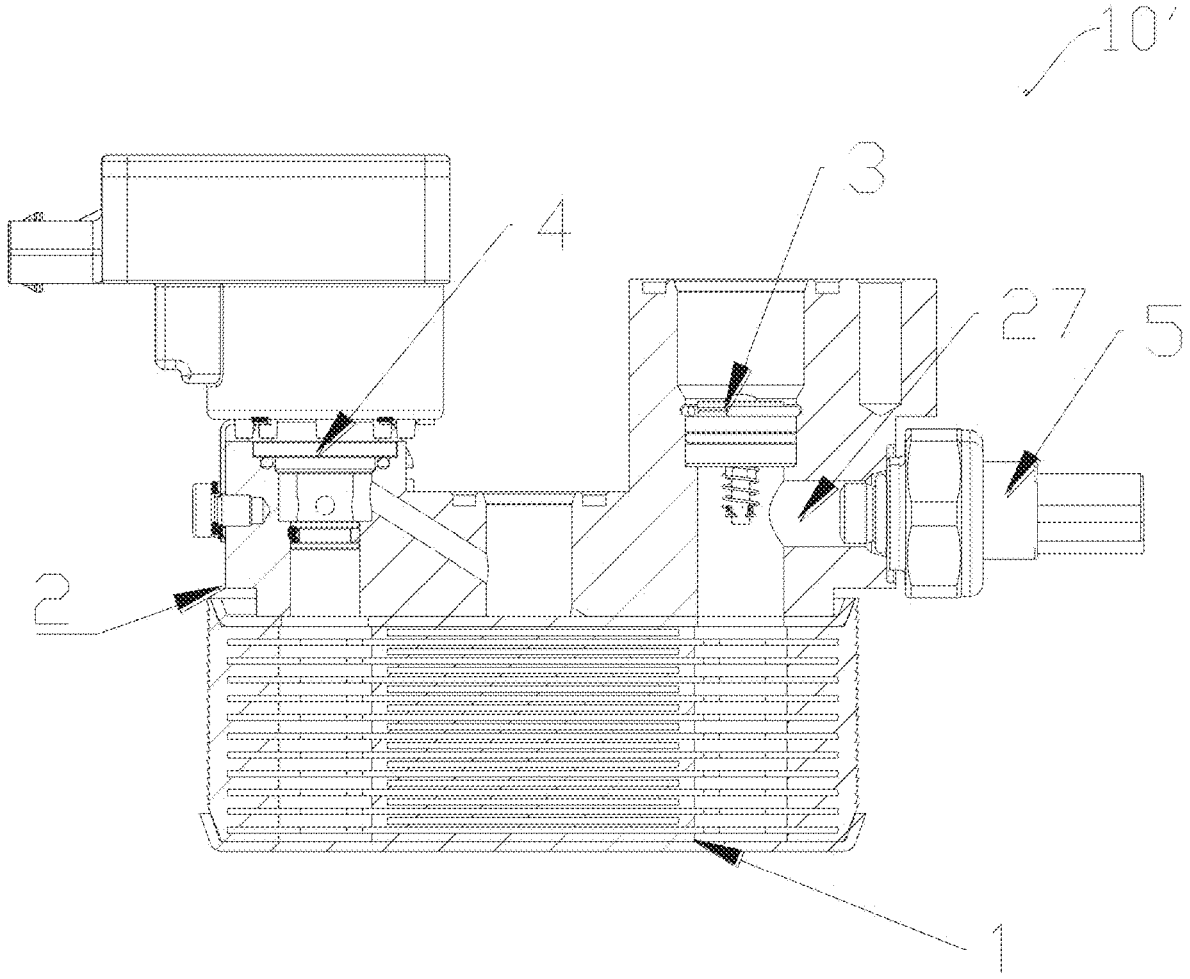
FIG. 17 is a schematic cross-sectional view of the structure shown in FIG. 16.

Reference is made in FIGS. 16 and 17, each of which shows a structure of the fluid control assembly according to another embodiment of the present application.

The fluid control assembly 10' includes a heat exchange core 1, a mounting block 2, a valve core member 3, a regulating valve member 4 and a sensor component 5. The heat exchange core 1 is fixed to the mounting block 2 by welding, the valve core member 3 and the mounting block 2 are arranged in a position limiting manner, and the sensor component 5 is connected to the mounting block 2 by thread. The sensor may measure the temperature or/and pressure in the fluid control assembly 10', and transmit the measurement data to an air conditioning controller or a vehicle controller, which facilitates the controller to accurately and quickly control the opening degree of the orifice of the regulating valve member 4 and other fluid control members, thereby improving the operational stability and the regulating flexibility of the refrigeration system or the battery cooling system.

The sensor component 5 may be a sensor component that only detects the pressure or a sensor component that only detects the temperature, which may be embodied with a pressure sensing portion or a temperature sensing portion, and the pressure sensing portion or the temperature sensing portion is arranged in the sensor hole passage. In this case, a value of the other parameter may be calculated based on a rotational speed or other parameters of the compressor. With this sensor, the cost can be reduced and the structure of the sensor can be simplified while meeting the requirements of the vehicle manufacturer.

The sensor component 5 may also be a sensor component that simultaneously detects the pressure and the temperature. That is, the sensor component may be embodied with a temperature and pressure sensing portion, and the temperature and pressure sensing portion is arranged in the sensor hole passage, which can improve the measurement accuracy. The sensor component has a better control effect than the sensor component that only measures the temperature or the pressure.

The mounting block 2 includes a sensor hole passage 27 that is arranged in communication with the first mounting hole passage 21. In the axial direction of the first mounting hole passage 21, the sensor hole passage 27 is arranged closer to the port 23 relative to the first position limiting portion 222, that is, the communication port of the sensor hole passage 27 and the first mounting hole passage 21 is arranged between the port 23 and the first position limiting portion 222.

Since the valve core member 3 is sealed with the wall portion 22 of the mounting block 2 that forms the first mounting hole passage 21, in order to ensure the sealing effect between the valve core member 3 and the mounting block 2, the valve core member 3 is arranged above the sensor hole passage 27 in the axis direction of the first mounting hole passage 21, so that the seal between the valve core member 3 and the mounting block 2 is not affected by the sensor hole passage 27. Herein, the position that the mounting block 2 is provided with the heat exchange core 1 is defined as a lower position, and a position opposite to the lower is an upper position.

The first mounting hole passage 21 is arranged in communication with one end of the sensor hole passage 27, and the communication portion between one end of the sensor hole passage 27 and the first mounting hole passage 21 is arranged in the first sub-passage 211. The wall portion of the mounting block 2 that is provided with the sensor hole passage 27 is provided with internal thread, and the sensor member 5 and the wall portion of the sensor hole passage 27 are fixed by thread. The sensor component 5 or at least a part of the sensor component 5 is arranged in the sensor hole passage 27.

The connecting manner between the sensor component 5 and the mounting block 2 is not limited to the thread connection, and other connection manners may be used.

It should be noted that the above embodiments are only used to illustrate the present application and are not intended to limit the technical solutions described in the present application, for example, the definition to the direction such as "front", "back", "left", "right", "upper" and "lower". Although the present application has been described in detail with reference to the embodiments described above, those skilled in the art should understand that a person skilled in the art can still make combination, modifications, or equivalent replacement to the present application, and all the technical solutions and improvements thereof without departing from the spirit and scope of the application are intended to be included within the claim scope of the present application.

The invention claimed is:

1. A fluid control assembly, comprising:

a heat exchange core comprising a fluid flow passage, wherein the fluid flow passage comprises a first hole passage and a second hole passage;

a mounting block fixed with the heat exchange core by welding and comprising a first mounting hole passage and a second mounting hole passage, wherein the first mounting hole passage is arranged in communication with the first hole passage, and the second mounting hole passage is arranged in communication with the second hole passage; and a valve core member, wherein at least a part of the valve core member is arranged in the first mounting hole passage, the mounting block further comprises a wall portion forming the first mounting hole passage, and the valve core member is sealable to at least a part of the wall portion, wherein the first mounting hole passage comprises a first sub-passage and a second sub-passage, the first sub-passage is arranged closer to the first hole passage relative to the second sub-passage, and the fluid control assembly further comprises a communication hole arranged between the first sub-passage and the second sub-passage, wherein the fluid flow passage further comprises the second hole passage, the first hole passage, the first sub-passage, the communication hole and the second sub-passage, and wherein the valve core member comprises a core body, the core body is configured to operate under a pressure difference between the first sub-passage and the second sub-passage, the first sub-passage is in communication with the second sub-passage through the communication hole in a case that the valve core member is in a valve-opened state, and the first sub-passage is not in communication with the second sub-passage in a case that the valve core member is in a valve-closed state.

2. The fluid control assembly according to claim 1, wherein the heat exchange core comprises a first port and a second port, and the fluid flow passage further comprises the first port, the second hole passage, the first hole passage, the first sub-passage, the communication hole, the second sub-passage and the second port, the valve core member further comprises a movable rod assembly, the movable rod assembly is movable relative to the core body in an axial direction of the first mounting hole passage, and the core body comprises the communication hole, the movable rod assembly is arranged in cooperation with the core body to block the communication hole from the second sub-passage or communicate the communication hole with the second sub-passage.

3. The fluid control assembly according to claim 2, wherein the mounting block comprises a first position limiting portion, a mounting block cooperating portion and a second position limiting portion that are integrally arranged on the wall portion, and the valve core member further comprises a first end wall portion and a valve core cooperating portion, the first end wall portion is arranged adjacent to the first position limiting portion or the first end wall portion is arranged in contact with the first position limiting portion, the valve core cooperating portion is arranged in cooperation with the mounting block cooperating portion, and the valve core cooperating portion is sealed with the mounting block cooperating portion, and wherein the second position limiting portion and the valve core member are arranged in a position limiting manner; or the fluid control assembly further comprises a first fixing member, the first fixing member and the second position limiting portion are arranged in the position limiting manner, and the first fixing member and the valve core member are arranged in the position limiting manner; or the fluid control assembly further comprises at least the first fixing member and a second fixing member, the first fixing member and the second position limiting portion are arranged in the position limiting manner, and the first fixing member and the valve core member are arranged in the position limiting manner, the second fixing member and the first position limiting portion are arranged in the position limiting manner, and the second fixing member and the first end wall portion are arranged in the position limiting manner.

4. The fluid control assembly according to claim 3, wherein in a case that the fluid control assembly further comprises the first fixing member, at least a part of the first fixing member is arranged at the second position limiting portion, the first fixing member comprises a circumferential side portion and a side wall portion, and the valve core member further comprises a second end wall portion, the second end wall portion is arranged farther away from the first hole passage relative to the first end wall portion, and the circumferential side portion of the first fixing member is arranged opposite to the second position limiting portion, at least a part of the circumferential side portion abuts against the second position limiting portion, at least one part of the side wall portion is arranged face to the second end wall portion, at least another part of the side wall portion is arranged in the second position limiting portion, and the at least one part of the side wall portion abuts against or is arranged adjacent to the second end wall portion.

5. The fluid control assembly according to claim 4, wherein the second position limiting portion comprises a positioning slot, an inner diameter of the positioning slot is larger than an outer diameter of the valve core member, and the circumferential side portion of the first fixing member is arranged face to and abuts against a bottom wall portion of the positioning slot.

6. The fluid control assembly according to claim 4, wherein the second position limiting portion comprises at least two positioning slots, the first fixing member further comprises a body portion and at least two convex portions, the at least two convex portions are radially arranged at an outer circumference of the body portion, each of the convex portions is arranged in cooperation with one of the positioning slots, and at least a part of the convex portion is arranged in the positioning slot, and the circumferential side portion of the first fixing member is arranged at the convex portion, at least a part of the circumferential side portion is arranged opposite to and abuts against the second position limiting portion, and wherein a side wall portion of the first fixing member comprises a first positioning sub-portion and a second positioning sub-portion, the first positioning sub-portion is arranged at the convex portion, the second positioning sub-portion is arranged at the body portion, and the second positioning sub-portion is arranged opposite to and abuts against the second end wall portion.

7. The fluid control assembly according to claim 4, wherein the second position limiting portion comprises at least two positioning holes, and the number of the first fixing member is two or more, at least a part of the first fixing member is arranged in the positioning hole, the first fixing member comprises a side wall portion, the side wall portion comprises a first positioning sub-portion and a second positioning sub-portion, and the first positioning sub-portion is arranged in the positioning hole, the second positioning sub-portion is arranged opposite to and abuts against the second end wall portion of the valve core member.

8. The fluid control assembly according to claim 3, wherein the mounting block cooperating portion comprises at least two sub-cooperating portions along an axial direction of the first mounting hole passage, the second position limiting portion is arranged between the two sub-cooperating portions, the second position limiting portion comprises at least one convex portion, the convex portion protrudes toward a center line of the first mounting hole passage, and a distance between a bottom of the convex portion and the center line of the first mounting hole passage is smaller than a distance between the sub-cooperating portion adjacent to the second position limiting portion and the center line of the first mounting hole passage.

9. The fluid control assembly according to claim 3, wherein the second position limiting portion comprises a threaded section, the valve core member further comprises a second end wall portion, the second end wall portion is arranged farther away from the first hole passage relative to the first end wall portion, an end of the threaded section extends from a position flushing with the second end wall portion in a direction away from the first hole passage along an axial direction of the first mounting hole passage, and in a case that the fluid control assembly further comprises the first fixing member, the first fixing member comprises a threaded portion that is arranged in cooperation with the threaded section and a side wall portion, and the side wall portion is arranged adjacent to or abuts against the second end wall portion.

10. The fluid control assembly according to claim 3, wherein the mounting block has an integral structure and comprises a port that is arranged in communication with the first hole passage, the first position limiting portion has an inner side and an outer side relative to a center line of the first mounting hole passage, the inner side of the first position limiting portion is arranged closer to the center line of the first mounting hole passage relative to the outer side of the first position limiting portion, and a distance L1 between a wall portion forming the port of the mounting block and the center line of the first mounting hole passage is larger than a distance L2 between the inner side of the first position limiting portion and the center line of the first mounting hole passage, the mounting block further comprises a guiding portion that is arranged at the wall portion of the first mounting hole passage, the guiding portion extends from the first position limiting portion toward the port of the mounting block, and a distance between each point of the guiding portion other than a point connected to the first position limiting portion and the center line of the first mounting hole passage is larger than the distance L2 between the inner side of the first position limiting portion and the center line of the first mounting hole passage, and the valve core member is arranged in the first mounting hole passage and does not extend into the first hole passage, and the first hole passage and the second hole passage are arranged at a same side of the heat exchange core.

11. A fluid control assembly according to claim 3, wherein the mounting block further comprises a port which is arranged in communication with the first hole passage, and a distance L1 between a wall portion forming the port of the mounting block and a center line of the first mounting hole passage is substantially equal to a distance L2 between an inner side of the first position limiting portion and the center line of the first mounting hole passage, and at least a part of the valve core member is arranged in the first hole passage, and the first hole passage and the second hole passage are respectively arranged at diagonal positions of the heat exchange core.

12. A fluid control assembly according to claim 5, wherein the mounting block further comprises a first wall section and a second wall section that are arranged at the wall portion, the second wall section connects the first wall section and the positioning slot, and the second wall section is reduced in diameter relative to the first wall section along an axial direction of the first mounting hole passage from the first wall section to the positioning slot.

13. The fluid control assembly according to claim 12, wherein the second wall section comprises a first portion and a second portion, the first portion is connected to the positioning slot, the second portion is connected to the first wall section, and a distance between the first portion and an axis of the first mounting hole passage is smaller than a distance between a bottom wall portion of the positioning slot and the axis of the first mounting hole passage.

14. A fluid control assembly according to claim 12, wherein the mounting block further comprises a third wall section that is arranged at the wall portion, the third wall section is arranged close to the heat exchange core, the first wall section of the wall portion is arranged close to the second port, an inner diameter of the third wall section is smaller than an inner diameter of the first wall section, and the inner diameter of the third wall section is larger than an outer diameter of the valve core member.

15. A fluid control assembly according to claim 1, wherein the fluid control assembly further comprises a sensor component, the mounting block further comprises a sensor hole passage, the sensor hole passage is arranged in communication with the first mounting hole passage, and the valve core member is arranged above the sensor hole passage in an axial direction of the first mounting hole passage.

16. A fluid control assembly according to claim 6, wherein the mounting block further comprises a first wall section and a second wall section that are arranged at the wall portion, the second wall section connects the first wall section and the positioning slot, and the second wall section is reduced in diameter relative to the first wall section along an axial direction of the first mounting hole passage from the first wall section to the positioning slot.

17. The fluid control assembly according to claim 16, wherein the second wall section comprises a first portion and a second portion, the first portion is connected to the positioning slot, the second portion is connected to the first wall section, and a distance between the first portion and an axis of the first mounting hole passage is smaller than a distance between a bottom wall portion of the positioning slot and the axis of the first mounting hole passage.

18. A fluid control assembly according to claim 16, wherein the mounting block further comprises a third wall section that is arranged at the wall portion, the third wall section is arranged close to the heat exchange core, a first wall section of the wall portion is arranged close to the second port, an inner diameter of the third wall section is smaller than an inner diameter of the first wall section, and the inner diameter of the third wall section is larger than an outer diameter of the valve core member.

* * * * *